US006083588A

United States Patent [19]

Kagawa et al.

[11] Patent Number: 6,083,588

[45] Date of Patent: Jul. 4, 2000

[54] FUSING DEVICE

[75] Inventors: Toshiaki Kagawa; Toshihiro Tamura, both of Sakurai; Shogo Yokota, Fujiidera; Tatuya Shinkawa, Nara; Hiroyuki Sawai, Nabari, all of Japan

[73] Assignee: Sharp Kabushiki Kaisha, Osaka, Japan

[21] Appl. No.: 08/582,482

[22] Filed: Jan. 3, 1996

[30] Foreign Application Priority Data

Mar. 3, 1995 [JP] Japan ..... 7-044647

[51] Int. Cl.[7] ..... G03G 15/20

[52] U.S. Cl. ..... 428/36.8; 428/36.9; 399/121; 399/122; 399/331; 492/46; 492/56

[58] Field of Search ..... 428/36.8, 36.9; 492/46, 56; 399/122, 121, 331

[56] References Cited

FOREIGN PATENT DOCUMENTS

0635767A2 1/1995 European Pat. Off. .

0661610A2 7/1995 European Pat. Off. .

55-36996 9/1980 Japan .

1304481 12/1989 Japan .

OTHER PUBLICATIONS

German Official Action dated Mar. 7, 1997; Serial No. 196 00 211.7–51.

*Primary Examiner*—Richard Weisberger

*Attorney, Agent, or Firm*—David G. Conlin; Dike, Bronstein, Roberts & Cushman, LLP

[57] ABSTRACT

A heat-resistant sheet is provided between a fusing roller and a pressing member made of a resilient material. The heat-resistant sheet is composed of a glass fiber substrate coated with or impregnating a fluororesin having good mold lubrication and heat-resistance, such as PFA and PTFE. A paper having a pre-fused toner image is carried through a section between the fusing roller and heat-resistant sheet. Accordingly, wear or separation of the heat-resistant sheet caused by friction with the fusing roller can be prevented, thereby improving durability of the heat-resistant sheet.

27 Claims, 22 Drawing Sheets

TOP END OF SHEET
(UPSTREAM SIDE)

BOTTOM END OF SHEET
(DOWNSTREAM SIDE)

TOP END OF SHEET (UPSTREAM SIDE)

BOTTOM END OF SHEET (DOWNSTREAM SIDE)

FUSING DEVICE

FIELD OF THE INVENTION

The present invention relates to a fusing device employed in an electrophotographic apparatus, such as an electrophotographic copying machine, an electrophotographic facsimile, and an electrophotographic printer.

BACKGROUND OF THE INVENTION

A conventional fusing device of a roller method, employed in an electrophotographic apparatus, such as an electrophotographic copying machine, an electrophotographic facsimile, and an electrophotographic printer, comprises a fusing roller and a pressing roller pressed against the fusing roller, whereby an image is fused onto a recording medium as the recording medium is carried through a section between the pair of rollers while one or both of the rollers are being heated.

In the fusing device of the roller method, however, the pair of rollers must be rotated synchronously. In addition, each roller must be supported so that it can rotate, which complicates the structure of the device and hence increases the size and manufacturing costs. To eliminate these problems, Japanese Examined Patent Publication No. 36996/1980 discloses a pressing pad method. More precisely, a non-rotational pressing member is pressed against the fusing roller instead of the pressing roller, whereby an image is fused onto a recording medium as the recording medium is carried through a section between the fusing roller and pressing member. Also, Japanese Laid-Open Patent Publication No. 304481/1989 discloses a pressing sheet method. More precisely, a pressing web member is pressed against the fusing roller at a predetermined contact angle instead of the pressing roller, whereby an image is fused onto a recording medium as the recording medium is carried through a section between the fusing roller and pressing web member.

An example fusing device of the pressing pad method will be explained with reference to FIG. 20. A fusing roller 112 comprises an aluminium hollow roller 112*a* whose outer circumference surface is coated with a coat layer 112*b* which is silicon rubber or the like having a large friction coefficient. A pressing member 111 is provided below the fusing roller 112, and the surface thereof opposing the fusing roller 112, namely, the pressing surface, is coated with a coat layer 114 made of, for example, polytetrafluoroethylene resin having a small friction coefficient. The pressing member 111 is fixed onto an upper surface of a pressing plate 116 supported by an axis 117, and pressed against the fusing roller 112 by a pressing spring 118 under a predetermined pressure. A pre-fused toner image 102 transferred onto a paper 101 is fused thereon as the paper 101 is carried through a section between the fusing roller 112 and pressing member 111.

Next, an example fusing device of the pressing sheet method will be explained with reference to FIG. 21. A fusing roller 122 comprises an aluminium hollow roller 122*a* whose outer circumference surface is coated with a coat layer 122*b* which is silicon rubber or the like having a large friction coefficient. A pressing web member 121, which is engaged with a frame 123 at one end and stretched out by a coil spring 128 with a predetermined tensile force at the other end, is pressed against the fusing roller 122 at a predetermined contact angle a. A pre-fused toner image 102 transferred onto a paper 101 is fused thereon as the paper 101 is carried through a section between the fusing roller 112 and pressing web member 121.

However, the fusing device of the pressing pad method has following problems:

1̂ Since the adhesion strength of the coat layer 114 to the pressing member 111 is weak, the coat layer 114 readily wears and separates from the pressing member 111 as the fusing roller 112 slides thereon.

2̂ Since a shear force develops and acts on the pressing member 111 when the fusing roller 112 rotates while no paper 101 is carried through the section between the fusing roller 112 and pressing member 114, for example, in case of a preliminarily rotation or intervals of continuous paper feeding, the pressing member 111 deforms as shown in FIG. 22.

3̂ When the pressing member 111 and pressing plate 116 are bonded together in a larger area to increase the adhesion strength, the size of the pressing member 111 and hence the manufacturing costs are undesirably increased.

4̂ If the pressing member 111 is too rigid, a sufficient nip width can not be secured and a toner image is fused unevenly in a longitudinal direction of the fusing roller 112. Whereas if the pressing member 111 is too soft, there readily occurs permanent deformation.

5̂ Since the pressing member 111 is fixed to the pressing plate 116, a paper is carried forward through a carrying force of the fusing roller 112 alone, which reduces the readiness in carrying papers and causes frequent paper jam.

6̂ If the coat layer 112*b* of the fusing roller 112 alone is to realize conflicting benefits, namely, mold lubrication and readiness in carrying papers, the carrying force must be increased considerably to an optimum level.

Also, the fusing device of the pressing sheet method has the following problems:

1̂ The contact angle a of the pressing web member 121 with respect to the fusing roller 122 must be increased to obtain a sufficient fusing force (fusing strength), which, in turn, curls the post-fused paper 101 more than necessary.

2̂ Since the pressure of the pressing web member 121 is distributed unevenly to the fusing roller 122 in the longitudinal direction thereof, a toner image is often fused unevenly.

In addition, the fusing devices of both the pressing pad method and pressing sheet method have a common problem. More precisely, in case of two-side printing or the like where a second toner image is fused onto a paper having recorded a first toner image on the back side thereof (hereinafter, referred to as used paper), the first toner image may be smeared (hereinafter, referred to as smeared image) as the back side of the used paper slides on the pressing member 111 or pressing web member 121, or there may occur frequent paper jam as the toner on the back side melts and adheres to the pressing member 111 or pressing web member 121.

SUMMARY OF THE INVENTION

It is therefore an object of the present invention to provide a high-quality fusing device with good durability, fusing reliability, and paper carrying ability having a heat-resistant sheet composed of a glass fiber substrate.

To fulfill the above object, a fusing device in accordance with the present invention is characterized by having:

a fusing roller;

a pressing device made of a resilient material, the pressing device being pressed against an outer circumference surface of the fusing roller under an even pressure; and a heat-resistant sheet composed of a substrate made of a glass fiber, the heat-resistant sheet being placed on a surface of the pressing device brought into contact with the fusing roller, a recording material being carried through a section between the fusing roller and heat-resistant sheet as the fusing roller rotates.

According to the above structure, a recording material is carried through the section between the fusing roller and heat-resistant sheet as the fusing roller rotates. Since the pressing device made of a resilient material is pressed against the outer circumference surface of the fusing roller evenly under a predetermined pressure, a pre-fused toner image on the recording material is fused thereon evenly. Further, since the substrate of the heat-resistant sheet is a glass fiber, the strength against a tensile force is reinforced. The heat-resistant sheet, therefore, will not go slack due to heat or a tensile force of the fusing roller. In addition, since the heat-resistant sheet renders excellent wear resistance with respect to the fusing roller, the durability of the heat-resistant sheet can be improved.

The heat-resistant sheet may be wider than the pressing device in a direction in which a recording material is carried forward, and the wider portion may be fixed to a pressing device fixing stand in an upstream side with respect to the pressing device in the same direction.

In this case, the heat-resistance sheet has a larger bonding area and secures sufficient bonding strength easily, thereby making it possible to prevent wear or separation from the pressing device. Also, since the heat-resistant sheet is fixed to the pressing device fixing stand in the upstream side in the direction in which a recording material is carried forward, the heat-resistant sheet can also serve as a paper guide. As a result, a paper can be carried forward in a stable manner. Also, since the heat-resistant sheet is fixed to the pressing device fixing stand, a shear force caused by the rotation of the fusing roller does not act on the pressing device. Thus, the pressing device does not deform and the durability thereof is improved. Further, since no shear force acts on the pressing device, the size of a bonding area of the pressing device, which is indispensable to fix the position thereof, is not especially limited. This can minimize the size of the pressing device, thus enabling a downsized fusing device and cost reduction.

Further, when the heat-resistant sheet and pressing device are not bonded together, the toner fusing reliability can be improved without impairing the pressing effect of the pressing device. In contrast, when the heat-resistant sheet and pressing device are bonded together, the nip width is narrowed because the pressing effect of the pressing device is reduced, and hence the toner fusing reliability is degraded compared with the above case.

Alternatively, metal foil may be inserted between the heat-resistant sheet and pressing device. In this case, heat released from the fusing roller and generated by the friction between the heat-resistant sheet and fusing roller are transferred to the metal foil instead of being accumulated within the heat-resistant sheet. Thus, the temperature of the heat-resistant sheet is not raised in the present invention, and for this reason, an image is hardly smeared. In addition, although the heat-resistant sheet is degraded due to repetitive heat accumulation over the long term use, the heat-resistant sheet renders excellent durability because the heat is transferred to the metal foil.

For a fuller under standing of the nature and advantages of the invention, reference should be made to the ensuing detailed description taken in conjunction with the accompanying drawings.

BRIEF DESCRIPTION OF THE DRAWINGS

FIG. 3(*b*) is a view explaining a state in which a paper carrying force of the fusing roller of the above fusing device is measured using a 100% black solid paper;

FIG. 7(*b*) is a cross sectional view of FIG. 7(*a*);

FIG. 8(*b*) is a view showing a case when the adhesion agent is also applied on the bottom-end portion of the sheet;

FIG. 9(*b*) is a view explaining a state where the heat-resistant sheet of FIG. 8(*b*) is attached to the lower frame;

FIG. 10(*b*) is a cross sectional view of FIG. 10(*a*);

FIG. 11(*b*) is a view showing a case when the width of the applied adhesion agent is minimum;

FIG. 12(*b*) is a view explaining a state where the heat-resistant sheet of FIG. 11(*b*) is attached to the lower frame;

FIG. 13(*b*) is a view explaining a state where the heat-resistant sheet and pressing member are attached to the lower frame completely;

FIG. 14(*b*) is a cross sectional view of FIG. 14(*a*);

FIG. 19(*b*) is a view explaining a case when an image is smeared;

FIG. 22 is a view explaining a state of the fusing device of FIG. 20 when no paper is carried through.

DESCRIPTION OF THE EMBODIMENTS

FIRST EMBODIMENT

Referring to FIG. 1 through 4, the following description will discuss an example of the first embodiment of the present invention. Assume that a fusing device in accordance with the first embodiment is used in a laser printer.

Figure 2:
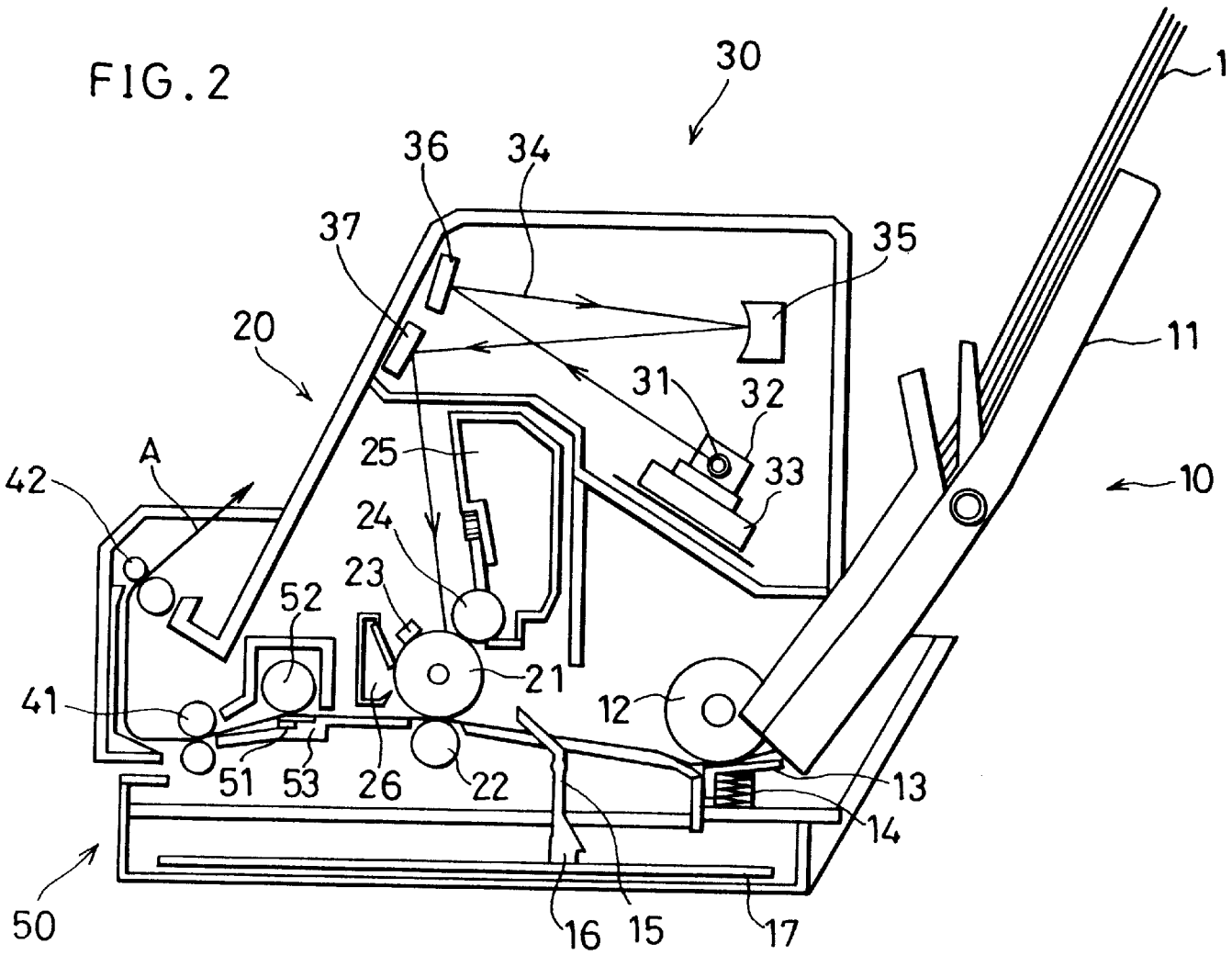
FIG. 2 is a schematic view of a laser printer employing the above fusing device.
Figure 3B:
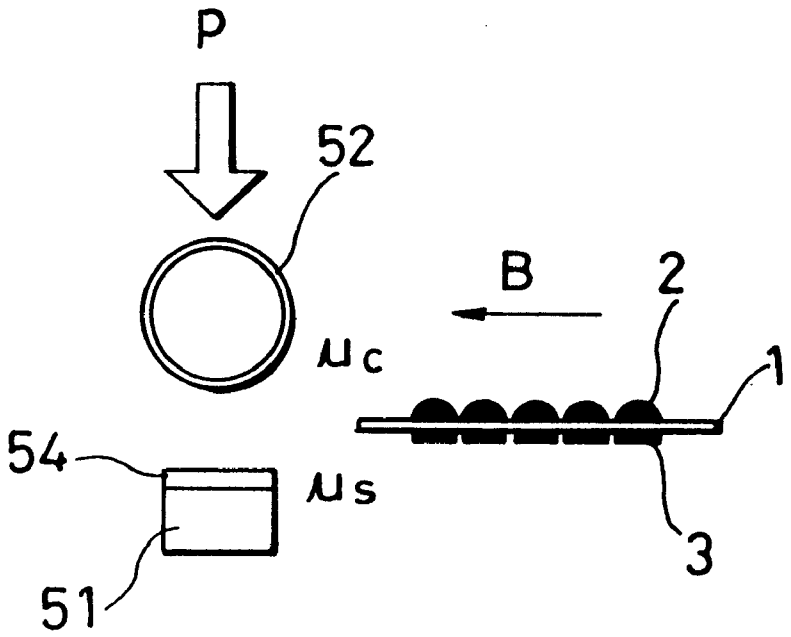
FIG. 3(*a*) is a view explaining a state in which a paper carrying force of a fusing roller of the above fusing device is measured using a white paper.
Figure 3A:
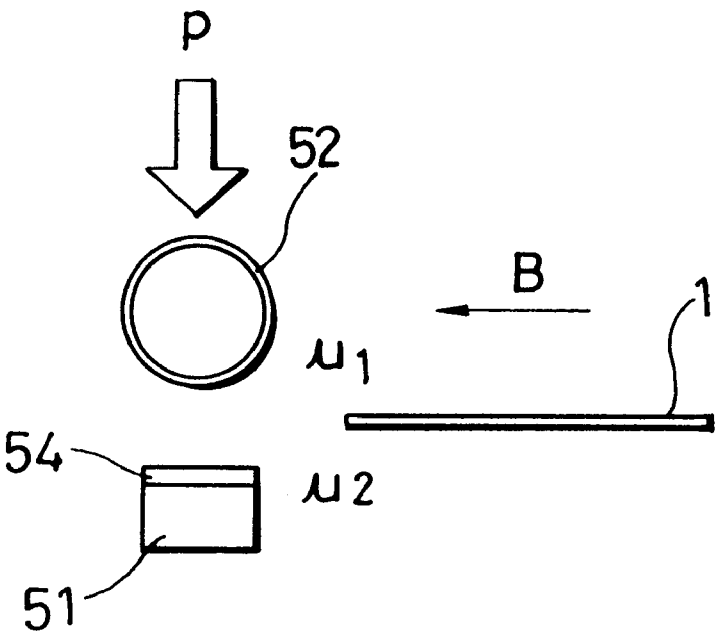

As shown in FIG. 2, the laser printer includes a paper feeding section 10, an image forming device 20, a laser beam scanning section 30, and a fusing device 50 of the present invention. The paper feeding section 10 carries a paper 1 to the image forming device 20 installed inside of the printer, and the image forming device 20 transfers a toner image onto the paper 1. The paper 1 is further carried forward to the fusing device 50 to fix the toner onto the paper 1, and released from the printer by means of paper carrying rollers 41 and 42. In short, the paper 1 is carried through the printer as indicated by a bold arrow A.

The paper feeding section 10 includes a paper feeding tray 11, a paper feeding roller 12, a paper separating friction plate 13, a pressing spring 14, a paper detecting actuator 15, a paper detecting optical sensor 16, and a control circuit 17.

When a print instruction is issued, a pile of the papers 1 placed on the paper feeding tray 11 are fed one by one to inside of the printer by means of the feeding roller 12, paper separating friction plate 13, and pressing spring 14. The paper 1 thus fed knocks the paper detecting actuator 15 over, which makes the paper detecting optical sensor 16 output an electric signal instructing the start of image printing. The control circuit 17 activated by the paper detecting actuator 15 sends an image signal to a laser diode emitting unit 31 of the laser beam scanning section 30, and controls the on/off action of an emitting diode.

The laser beam scanning section 30 includes the laser diode emitting unit 31, a scanning mirror 32, a scanning mirror motor 33, and reflecting mirrors 35 through 37.

A laser beam 34 emanated from the laser diode emitting unit 31 is irradiated to a photosensitive body 21 by way of the reflecting mirrors 36, 35, and 37. The photosensitive body 21 will be explained below. Since the scanning mirror 32 furnished with the laser diode emitting unit 31 is driven by the scanning mirror motor 33 to rotate at a fast constant rate, the laser beam 34 scans in a longitudinal direction of the photosensitive body 21. Also, the laser beam 34 selectively exposes the photosensitive body 21 based on information from the control circuit 17 as to the on/off action.

The image forming device 20 includes the photosensitive body 21, a transfer roller 22, a charging member 23, a developing roller 24, a developing unit 25, and a cleaning unit 26.

An electrostatic latent image is formed when the charges on the surface of the photosensitive body 21, which are charged by the charging member 23 in advance, are selectively released by the laser beam 34. The toner used in developing the electrostatic latent image is stored in the developing unit 25. The toner, charged while it is stirred adequately within the developing unit 25, adheres to the surface of the developing roller 24. Then, the electrostatic latent image is developed into a toner image on the photosensitive body 21 by a bias voltage applied across the developing roller 24 and an electric field developed by the surface potential of the photosensitive body 21.

The paper 1 fed from the paper feeding section 10 is sandwiched between the photosensitive body 21 and transfer roller 22 and further carried forward. The toner on the photosensitive body 21 is electrically attracted to the paper 1 and transferred thereon through an electric field developed by a transfer voltage applied across the transfer roller 22. Note that, at this point, some of the toner on the photosensitive body 21 is transferred onto the paper 1 by the transfer roller 22 and the residual toner on the photosensitive body 21 is collected by the cleaning unit 26.

Subsequently, the paper 1 is carried to the fusing device 50, and the toner melts and fixes onto the paper 1 as adequate temperature and pressure are applied thereto by means of a pressing member 51 and a fusing roller 52 kept at 140° C., thereby forming a steady image. Then, the paper 1 is further carried forward by means of the paper carrying rollers 41 and 42 and released from the laser printer. The fusing device 50 will be explained more in detail.

Figure 1:
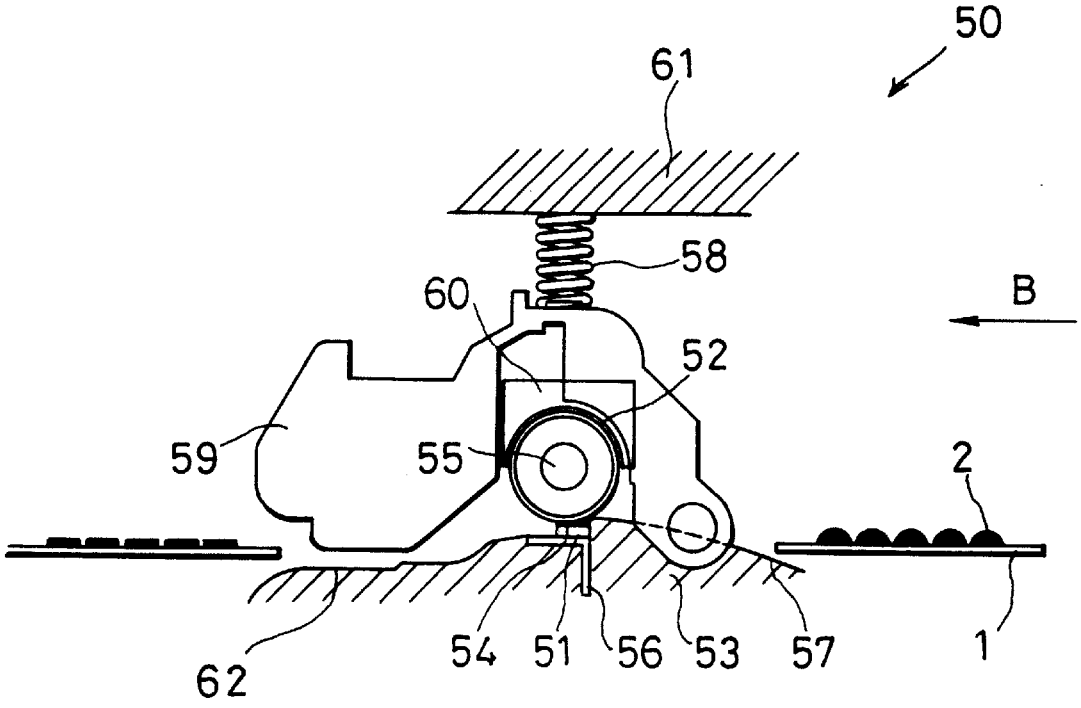
FIG. 1 is a cross sectional view depicting the structure of an example fusing device in accordance with the first embodiment of the present invention.

As shown in FIG. 1, the fusing device 50 includes the pressing member 51, the fusing roller 52, and a lower frame (pressing member fixing stand) 53. The fusing roller 52 is composed of a thin aluminium cylinder whose outer circumference surface is entirely coated with a synthetic resin material having good mold lubrication, paper carrying ability, and heat resistance, for example, heat-resistant silicon rubber. A heater lamp 55 is installed in the center of axis of the fusing roller 52.

A semi-circle bearing 60 (S-Bear SS745: Starlite Co., Ltd.) is placed in the upper half of the fusing roller 52 in the vicinity of each end thereof, which is more clearly shown in FIG. 5 referred in the second embodiment below. Each bearing 60 is fitted into a fusing cover 59 made of a heat-resistant resin (G-PET: Mitsubishi Petrochemical Co., Ltd.). A pressure of 1200 gf is applied to the fusing cover 59 by an upper frame 61 through a pressing spring 58.

The pressing member 51 is silicon sponge rubber (Silicon Sponge Rubber TL4400: Inoak Co., Ltd.) of 2 mm thick having a hardness of about 30° in ASKER C. The pressing member 51 is placed between an L-shaped metal plate 56 (SECC:thickness t1) and the outer circumference surface of the fusing roller 52, and pressed against the fusing roller 52 by the pressing spring 58. Also, the pressing member 51 is fixed to the L-shaped metal plate 56 by a heat-resistant double-side adhesive tape (Double-side Adhesive Tape 5302A: Nitto Denko Corp.). Further, the pressing member 51 is fitted into a boss extruding from the lower frame 53 in the vicinity of each end in a longitudinal direction of the L-shaped metal plate 56, and thus fixed to the lower frame 53.

A heat-resistant sheet 54, which is inserted in a section between the pressing member 51 and fusing roller 52, is fixed to the pressing member 51 by a heat-resistant double-side adhesive tape. The heat-resistant sheet 54 is composed of a glass fiber substrate (100 m thick) coated with or impregnating a synthetic resin material (100 m thick) having satisfactory mold lubrication and heat resistance, such as fluororesins represented by PFA (polytetrafluoroethylene=perfluoroalkylvinylether copolymer resin) or PTFE (polytetrafluoroethylene resin). In short, the heat-resistant sheet 54 is 200 $\mu$m thick. In the present embodiment, the heat-resistant sheet 54 is a PTFE sheet having a friction coefficient ranging from 0.04 to 0.1 with aluminium.

The upstream side of the lower frame 53 with respect to the fusing roller 52 (the side from which the paper 1 is carried from) is higher than the downstream side substantially by a total of the thicknesses of the pressing member 51 and heat-resistant sheet 54, and the L-shaped metal plate 56 is fitted into a boundary portion of the two levels. Thus, the upstream side forms a pre-fused paper guide 57 for guiding the paper 1 being carried forward. On the other hand, the downstream side forms a post-fused paper guide 62 for guiding the post-fused paper 1 being released.

According to the above structure, the paper 1 having a pre-fused toner image 2 moves in the direction in which a paper is carried forward (the direction indicated by an arrow B), and passes by a nip portion between the fusing roller 52 and heat-resistant sheet 54 with the guidance of the pre-fused paper guide 57. At this point, the pre-fused toner image 2 adhering to the paper 1 through static electricity is fixed onto the paper 1 by heat and pressure applied by the fusing roller 52, thereby forming a desired letters or graphics. Subsequently, the paper 1 passes by the post-fused paper guide 62 and is released from the printer. The fusing action in an electrophotographic process is completed by the above structure.

In the above structure, the fusing roller 52 must have a sufficient paper carrying force to carry a paper in the direction in which the paper is to be carried. The paper carrying force respectively required for carrying (a) a white paper and (b) a 100% black solid paper will be explained with reference to FIG. 3 as a simple example. "The 100% black solid paper" referred herein means a paper having a pre-fused black solid toner image 2 on the fusing roller 52 side and a post-fused black solid toner image 3 on the heat-resistant sheet 54 side.

(a) In case of carrying a white paper, a relation expressed by Equation (1) below must be satisfied:

$$\mu_1(t_1,m)\cdot p>\mu_2(t_2,m)\cdot p+M_p \quad (1)$$

where $\mu_1$ is a friction coefficient between a coating material of the fusing roller 52 and the paper 1, $\mu_2$ is a friction coefficient between a material of the heat-resistant sheet 54 and the paper 1, p is a pressure applied to the paper 1, and $M_p$ is resistance and a carrying force of the paper 1. In short, the relation, $\mu_1>\mu_2$, must be satisfied. Note that, however, the friction coefficient $\mu_1$ depends on the temperature and kinds of the coating material, and similarly, the friction coefficient $\mu_2$ depends on the temperature and kinds of the sheet material.

In other words, increasing the friction coefficient $\mu_1$ between the fusing roller 52 and paper 1 by changing the friction coefficient $\mu_2$ between the heat-resistant sheet 54 and paper 1 makes it possible to carry a paper in a stable manner, thereby causing paper jam less frequently.

Let the friction coefficient $\mu_2$ be 0.1, applied pressure p be 1400 gf, and carrying force $M_p$ be 100 gf in the present embodiment, then the friction coefficient $\mu_1$ must be 0.17 or more. If the applied pressure p is decreased to 1000 gf, then the friction coefficient $\mu_1$ must be 0.2 or more. Further, if the friction coefficient $\mu_2$ is increased to 0.15, then the friction coefficient $\mu_2$ must be 0.25 or more. Thus, it is understood that the smaller the friction coefficient $\mu_2$ the material of the heat-resistant sheet 54 has with the paper 1 and the higher the applied pressure p, the better the fusing device. Note that, however, raising the applied pressure p more than necessary increases a friction torque, thereby increasing overall manufacturing costs of the fusing device.

(b) In case of carrying a 100% black solid paper, a relation expressed by both Equations (2) and (3) below must be satisfied:

$$\mu_c(t_1,m)\cdot p>\mu_s(t_2,m)\cdot p+M_p \quad (2)$$

$$F_2,\ F_2'>F_3>F_1 \quad (3)$$

where $\mu_c$ is a friction coefficient between the coating material of the fusing roller 52 and paper 1, $\mu_s$ is a friction coefficient between the material of the heat-resistant sheet 54 and paper 1, p is a pressure applied to the paper 1, $M_p$ is resistance and a carrying force of the paper 1, $F_1$ is a surface tension (mold lubrication resistance) between the coating material and toner, $F_2$ is a surface tension (mold lubrication resistance) between the surface of the paper 1 in the fusing roller 52 side and toner, $F_2'$ is a surface tension (mold lubrication resistance) between the surface of the paper 1 in the heat-resistant sheet 54 side and toner, and $F_3$ is a surface tension (mold lubrication resistance) between the sheet material and toner. Note that, however, like in the case of carrying a white paper, the friction coefficients $\mu_c$ and $\mu_s$ and surface tensions $F_1$, $F_2$, $F_2'$, and $F_3$ are determined depending on the temperature and kinds of the materials.

The fluidity of toner varies in response to temperatures, and the surface tension and friction coefficient with the other materials increase as the temperature rises. Therefore, the conditions are more strict in case of carrying a 100% black solid paper compared with a case of carrying a white paper. More specifically, in case of carrying a 100% black solid paper, the relation, $\mu_s>\mu_2$ must be satisfied, and a coating material must have a larger friction coefficient $\mu_s$, that is, a larger carrying force $M_p$, compared with a case carrying a white paper.

Next, the state of a paper after it was carried through by the above structure was evaluated using a double-side black solid paper with a toner density of 1.4 (surface opposing the fusing roller 52: pre-fused black solid, surface opposing the heat-resistant sheet 54: post-fused black solid). Five types of fusing roller 52 each respectively having a carrying force of 170 gf, 250 gf, 300 gf, 500 gf, and 1500 gf with mold lubrication, heat resistance, and paper carrying ability were used. A paper was carried in a multi-print condition and a single multi-print condition: in the former, a paper was carried every three seconds and the temperature was kept at 140° C. for three seconds during which no paper was carried, and in the latter, a paper was carried every 60 seconds and the temperature was not controlled for 60 seconds during which no paper was carried. A paper carrying rate was 25 mm/sec in either condition. The results of evaluation are set forth in TABLE 1 below.

TABLE 1

| PAPER CARRYING FORCE (gf) | READINESS IN CARRYING SAMPLE PAPER MULTI-PRINT | SINGLE-MULTI PRINT | EVALUATION |
|---|---|---|---|
| 170 | X | X | C |
| 250 | Δ | X | B |
| 300 | ○ | ○ | A |
| 500 | ○ | ○ | A |
| 1500 | ○ | ○ | A |

Sample paper - the back side is 100% black solid
Readiness
○: fair
Δ: occasionally poor
X: poor
Evaluation
A: fair
B: occasionally poor
C: poor TABLE 1 reveals that when the fusing roller 52 had a paper carrying force of 300 gf, 500 gf, or 1500 gf, the papers were carried readily in the multi-print and single multi-print conditions. Further, the fusing roller 52 was subject to idle rotation and the heat-resistant sheet 54 was subject to friction at 140° C. for a period equal to the fusing device 50's life span, 60 K. In other words, since the laser printer used in the present embodiment prints four papers per minute, the fusing roller 52 was subject to idle rotation for continuous 15000 minutes (250 hours) at 140° C. As a result, the paper carrying force was reduced by 10%. The reasons for such reduction are (1) the friction between the fusing roller 52 and heat-resistant sheet 54 (PTFE sheet herein), and (2) the transfer of PTFE of the PTFE sheet 54 to a coat layer side of the fusing roller 52.

In view of the foregoing, it is understood that a preferred paper carrying force of the fusing roller 52 is 300 gf or more. Any kind of papers can be carried in a stable manner without causing any paper jam by determining the minimum paper carrying force, and when the paper carrying force is set approximately to the minimum paper carrying force, a fusing roller 52 having satisfactory toner mold lubrication can be obtained. Herein, the optimal carrying force is about 350 gf.

Figure 4:
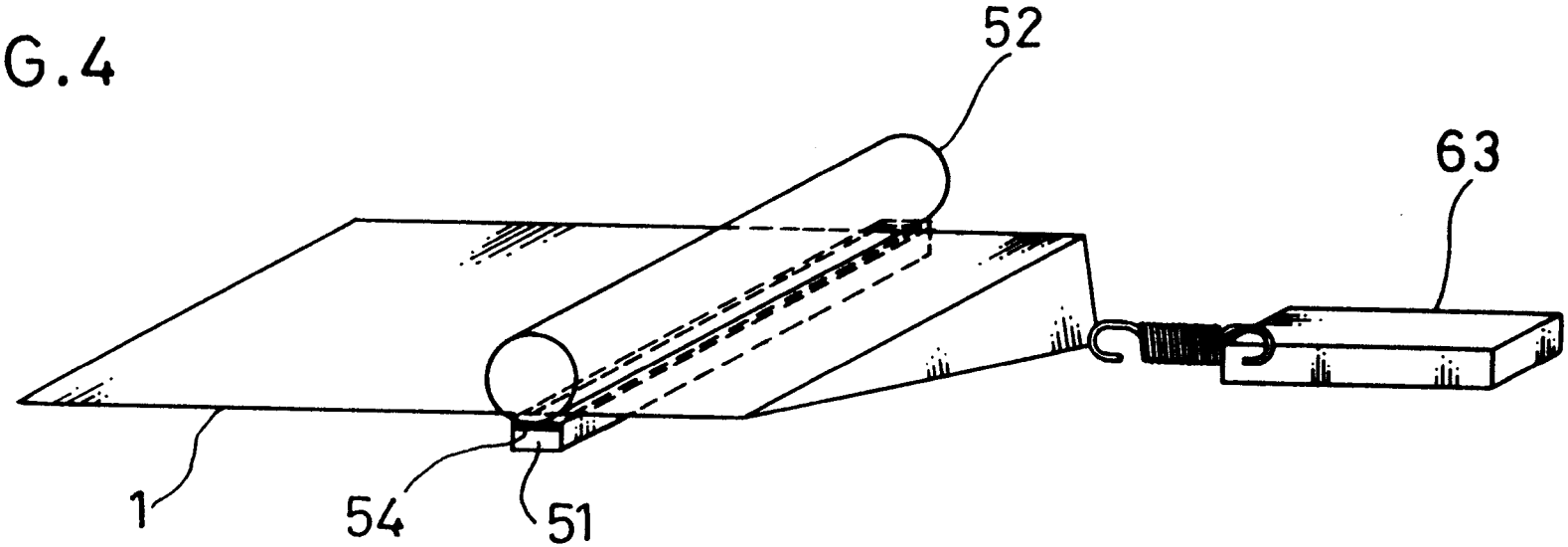
FIG. 4 is a perspective view showing a measuring method of the above paper carrying force.

Next, a method of measuring the paper carrying force will be explained with reference to FIG. 4.

The paper 1, namely, a white paper (128 g), is inserted into the section between the fusing roller 52 and heat-resistant sheet 54. Then, the paper 1 is carried forward by rotating the fusing roller 52 while the temperature thereof is kept at 140° C. Under these conditions, when a spring scale 63 attached to the paper 1 is pulled, the carrying action of the paper 1 is suspended while the fusing roller 52 keeps rotating. As the tensile force of the spring scale 63 is gradually reduced, the carrying action of the paper 1 resumes at some point, and the value of the spring scale 63 at that point is recorded as the carrying force.

SECOND EMBODIMENT

Referring to FIGS. 5 through 14, the following description will discuss an example of the second embodiment in accordance with the present invention. Hereinafter, like components are labeled with like reference numerals with respect to the first embodiment, and the description of these components is not repeated for the explanation's convenience.

Figure 5:
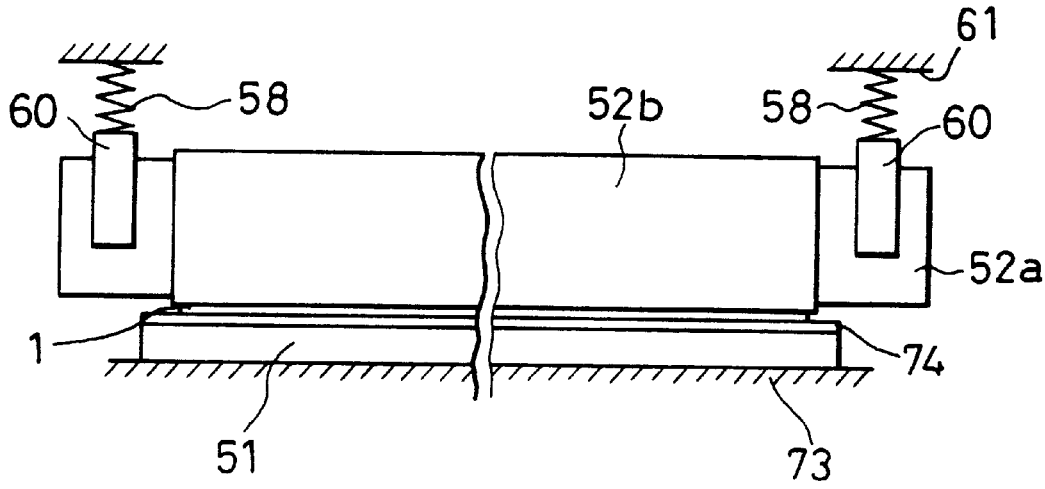
FIG. 5 is a front view depicting the structure of an example fusing device in accordance with the second embodiment of the present invention.
Figure 6:
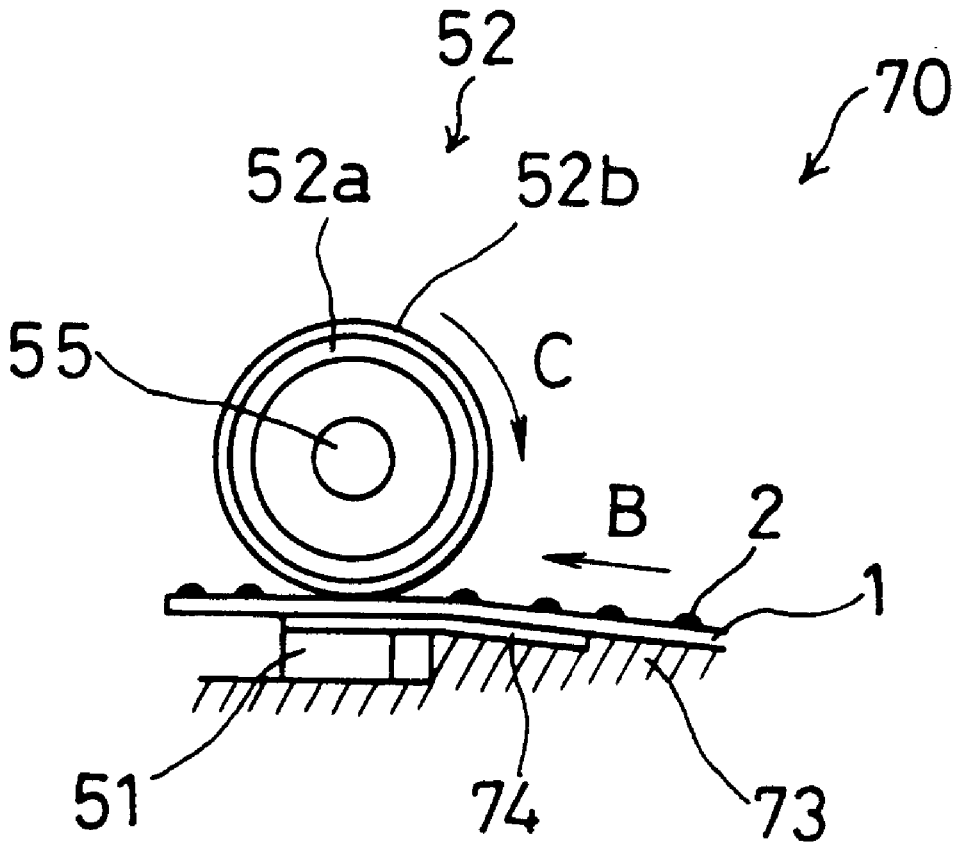
FIG. 6 is a cross sectional view of the above fusing device.

A fusing device of the present embodiment will be explained with reference to FIGS. 5 and 6. A fusing device 70 includes a lower frame 73, and the pressing member 51 and fusing roller 52 which are identical with their counterparts in the first embodiment. More specifically, the fusing roller 52 is composed of a thin aluminium cylinder 52*a* whose outer surface is coated with the synthetic resin material 52*b* having good mold lubrication and heat resistance, such as silicon rubber, and the heater lamp 55 is installed in the center of axis thereof.

The fusing roller 52 is rotatably supported by two bearings 60 provided at the both ends thereof, respectively. The bearings 60 are attached to the upper frame 61 through two pressing springs 58, respectively. Thus, the fusing roller 52 is pressed against a heat-resistant sheet 74 and the pressing member 51 under a predetermined pressure of 1200 gf by the pressing springs 58. The nip width formed between the fusing roller 52 and heat-resistant sheet 74 under these conditions is about 1 mm.

The pressing member 51 is placed below the fusing roller 52 through the heat-resistant sheet 74. The pressing member 51 is silicon sponge rubber of 2 mm thick having a hardness of about 30° in ASKER C. The pressing member 51 is bonded to the lower frame 73 by a double-side adhesive tape.

The heat-resistant sheet 74 is wider than the pressing member 51 in the direction in which a paper is carried forward (the direction indicated by an arrow B). The heat-resistant sheet 74 is bonded to the lower frame 73 in a predetermined width, a method of which will be explained below. The heat-resistant sheet 74 is composed of a glass fiber substrate of 50 μm thick coated with or impregnating a synthetic resin material (50 μm thick) having good mold lubrication and heat resistance, such as fluororesins represented by PFA, PTFE, and the like. In short, the heat-resistant sheet 74 is 100 μm thick.

The lower frame 73 has steps. More specifically, the upstream side (the side from which a paper is carried) of the lower frame 73 with respect to the fusing roller 52 is higher than the downstream side substantially by the thickness of the pressing member 51. The upper step of the lower frame 73 is also leveled: the upper level is higher than the lower level by the thickness of the heat-resistant sheet 74. According to these steps and levels, a paper 1 can be carried smoothly without being hooked by the heat-resistant sheet 74 when the heat-resistant sheet 74 is bonded to the lower frame 73.

According to the above structure, when an image is to be printed, the fusing roller 52 rotates in a direction indicated by an arrow C while being heated by the heater lamp 55 and kept at 140° C. by an unillustrated thermo-controller. Then, a paper 1 having a pre-fused toner image 2 thereon is carried to the nip portion. Here, the paper 1 is carried forward by the rotation of the fusing roller 52 and the toner image is fused onto the paper 1, because the paper 1 causes a larger friction with the fusing roller 52 than the heat-resistant sheet 74.

Figure 13A:
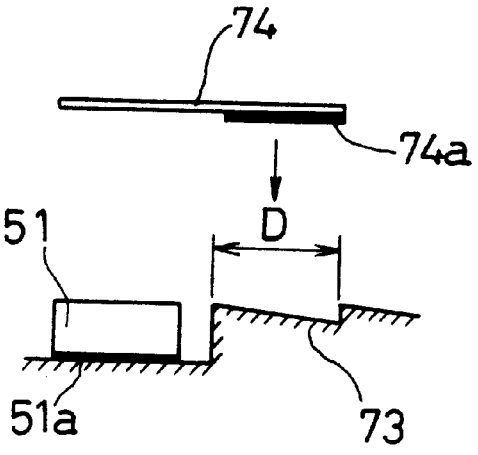
FIG. 13(*a*) is a view explaining a method of attaching the heat-resistant sheet and a pressing member to the lower frame.
Figure 13B:
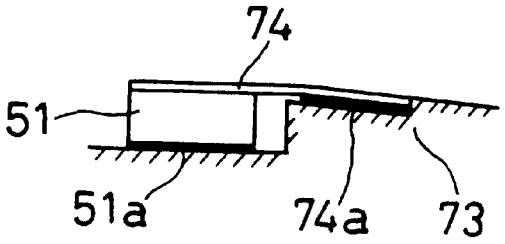
Figure 14A:
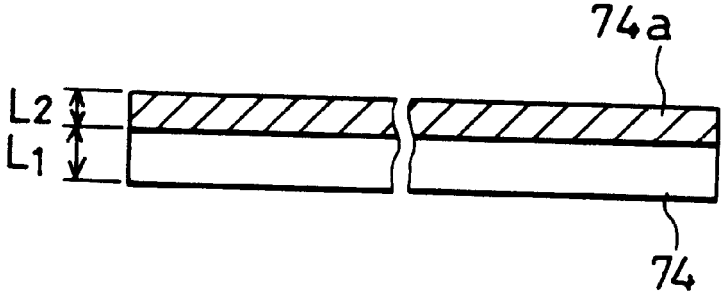
FIG. 14(*a*) is a front view showing a shape of the above heat-resistant sheet.
Figure 14B:
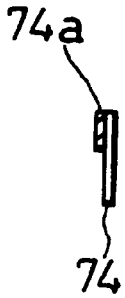

Next, a method of attaching the heat-resistant sheet 74 and pressing member 51 to the lower frame 73 will be explained with reference to FIGS. 13 and 14. As shown in FIG. 13(*a*), the pressing member 51 is fixed onto the lower frame 73 by a double-side adhesive tape 51*a* to begin with, and as shown in FIG. 14, an adhesive agent 74*a* is applied to the back side of the heat-resistant sheet 74 in a width of $L_2$ in the upstream side. "The back side in the upstream side" referred herein means the side from which the paper 1 is carried forward over the surface of the heat-resistant sheet 74 bonding to the lower frame 73. Then, as shown in FIG. 13(*a*), the heat-resistant sheet 74 applied with the adhesive agent 74*a* is bonded to a step surface D of the lower frame 73 in the upstream side in the direction in which a paper is carried forward. Note that, however, the heat-resistant sheet 74 is not bonded to the pressing member 51. FIG. 13(*b*) shows a state when the attachment of the pressing member 51 and heat-resistant sheet 74 to the lower frame 73 is completed.

Figures 7A, 7B:
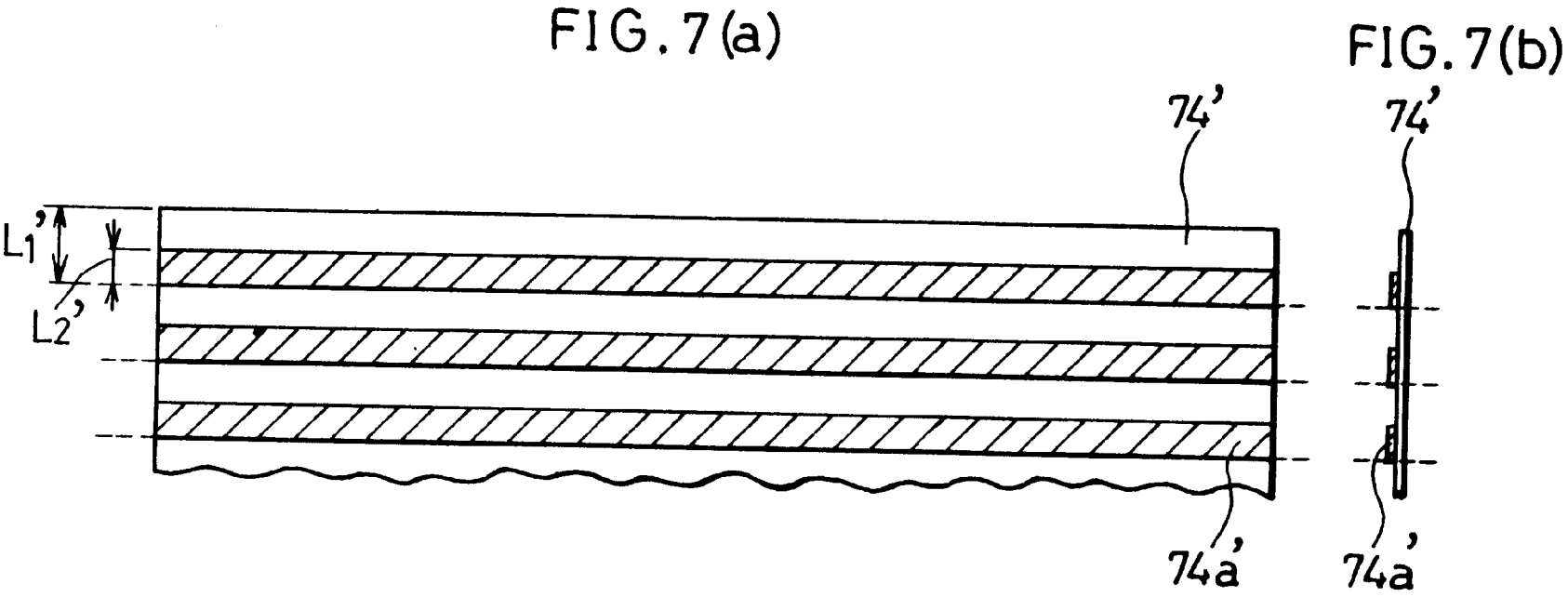
FIG. 7(*a*) is a front view showing a piece of sheet produced as a result of applying a conventional sheet producing method to produce a heat-resistant sheet in accordance with the second embodiment of the present invention.

Next, a method of producing the heat-resistant sheet 74 will be explained with reference to FIGS. 7 through 12. A sheet with an adhesive agent used for a conventional fusing device is produced by a die cutting method. If the heat-resistant sheet 74 is produced by this method, then a heat-resistant sheet 74' of $L_1$' wide as shown in FIG. 7 is produced by the following procedures:

1) an adhesive agent 74*a*' is applied on the back side of a piece of sheet in stripes of $L_2$' wide; and
2) the piece of sheet is cut out along broken lines.

Figure 8A:
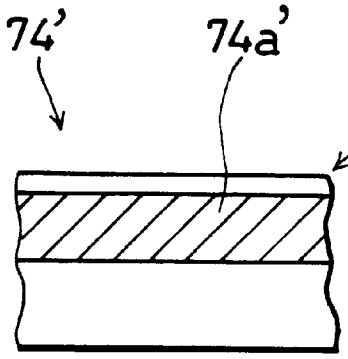
FIG. 8(*a*) is a view showing a state where an adhesion agent is applied on the heat-resistant sheet produced by the above method, and shows a case when the adhesion agent is not applied on the top-end portion of the sheet.
Figure 8B:
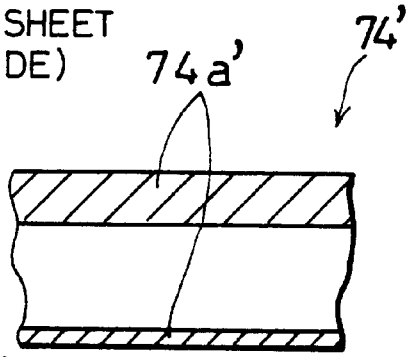
Figure 9A:
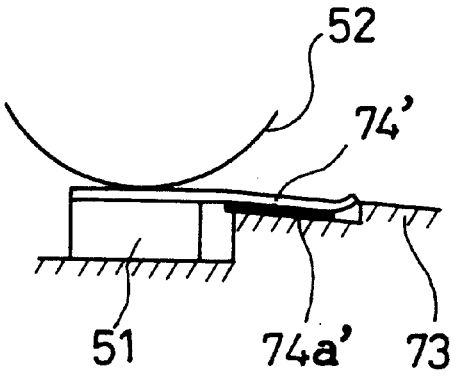
FIG. 9(*a*) is a view explaining a state where the heat-resistant sheet of FIG. 8(*a*) is attached to a lower frame.
Figure 9B:
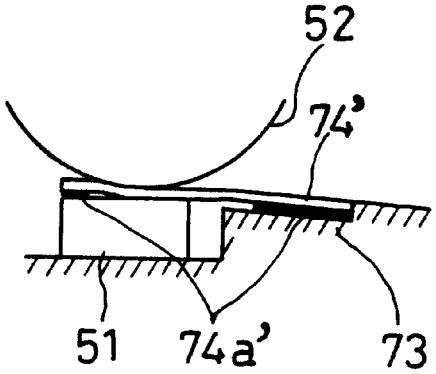

In this method, if the cutting of the piece of sheet is not accurate, a resulting heat-resistant sheet 74' may not have the adhesive agent 74*a*' at the top end as shown in FIG. 8(*a*), or may also have the adhesive agent 74*a*' at the bottom end as shown in FIG. 8(*b*). If the heat-resistant sheet 74' of FIG. 8(*a*) is fixed to the lower frame 73, the end thereof is rolled up as shown in FIG. 9(*a*), which causes paper jam. If the heat-resistant sheet 74' of FIG. 8(*b*) is fixed to the lower frame 73, the heat-resistant sheet 74' adheres to the pressing member 51 partially, which causes a defect in fusing.

Figure 10B:
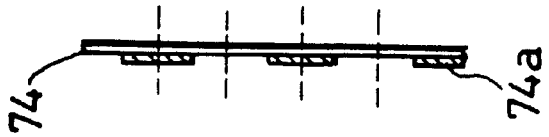
FIG. 10(*a*) is a front view showing a producing method of the heat-resistant sheet in accordance with the second embodiment.
Figure 10A:
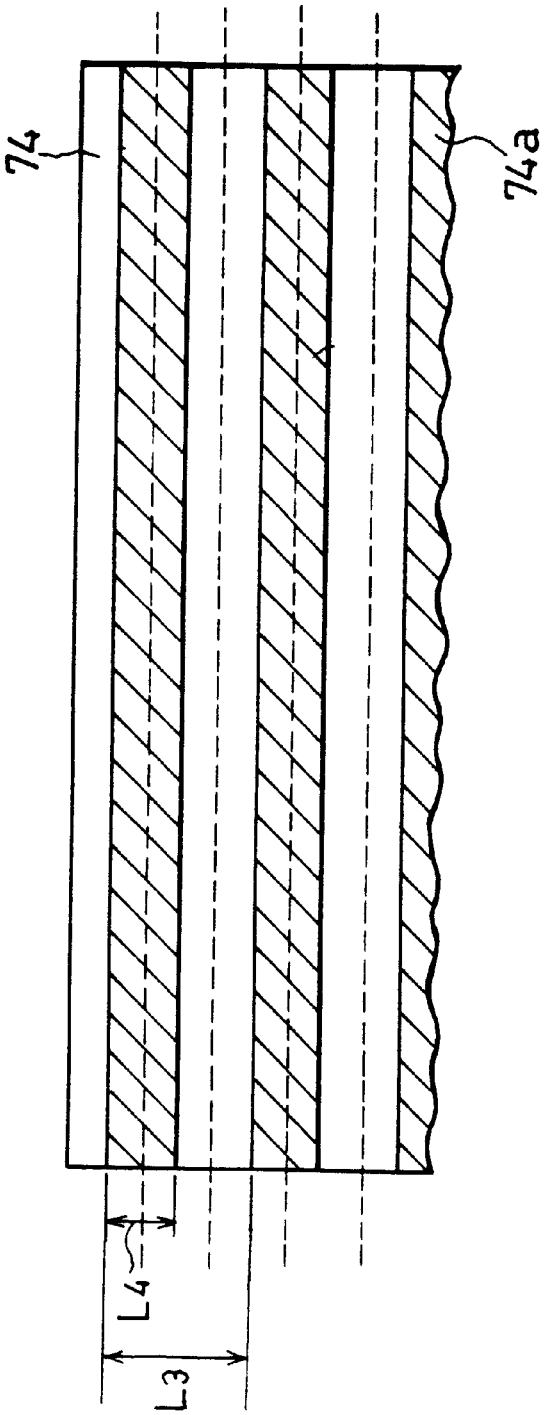

In view of the foregoing, the heat-resistant sheet 74 of the present embodiment is produced by the following method. As shown in FIG. 10, the adhesive agent 74*a* is applied to the back side of the piece of sheet in strips of $L_4$ wide ($=2\times L_2'$) in a pitch of $L_3$ wide ($=2\times L_1'$) in a direction along the axis of the fusing roller 52. The sheet is cut out along broken lines in the center of the area (strips) where the adhesive agent 74*a* is applied and in the center of the area where no adhesive agent 74*a* is applied in the direction along the axis of the fusing roller 52.

Figure 11A:
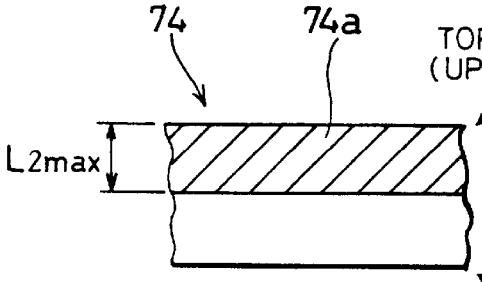
FIG. 11(*a*) is a view showing a state of an adhesion agent applied on the heat-resistant sheet produced by the above method, and shows a case when the width of the applied adhesion agent is maximum.
Figure 11B:
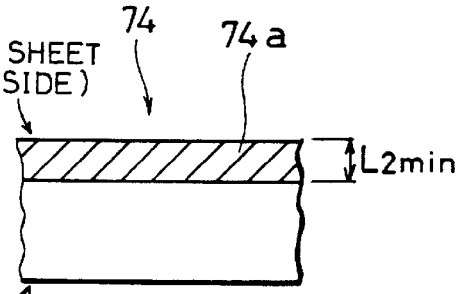
Figure 12A:
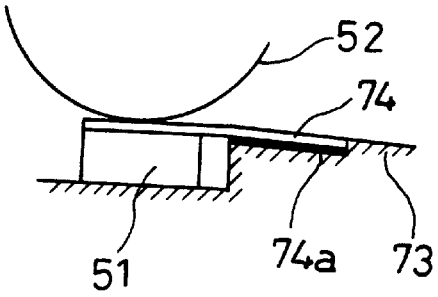
FIG. 12(*a*) is a view explaining a state where the heat-resistant sheet of FIG. 11(*a*) is attached to a lower frame.
Figure 12:
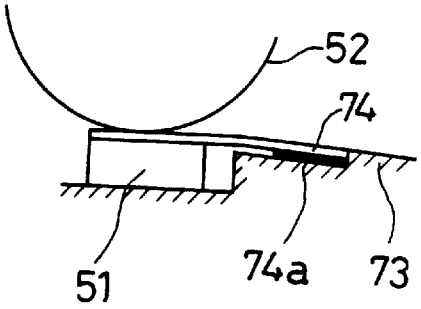

In this case, even if the sheet is not cut out accurately, the adhesive agent applied portion varies in width only in a range between the minimum width $L_{2min}$ and maximum width $L_{2max}$ as shown in FIG. 11. Thus, the probability of producing the heat-resistant sheet 74' whose top end is not applied with the adhesive agent 74*a*' or whose bottom end is also applied with the adhesive agent 74*a*' is reduced to almost nil. Therefore, not only an inexpensive heat-resistant sheet 74 can be produced, but also the quality of the fusing device 70 can be further stabilized.

In the present embodiment, the position of the pressing member 51 is determined in such a manner that the adhesive agent 74*a* will not adhere to the pressing member 51 even when the adhesive agent 74*a* is applied in the maximum width of $L_{2max}$ as shown in FIG. 11(*a*). Also, the pitch width $L_3$ of the adhesive agent 74*a* and the width of the heat-resistant sheet 74 are determined in such a manner that the adhesive agent 74*a* will have sufficient strength even when the adhesive agent 74*a* is applied in the minimum width of $L_{2min}$ as shown in FIG. 11(*b*).

During a period in which no paper 1 is carried through, such as a preliminary rotation or intervals in continuous paper feeding, the heat-resistant sheet 74 is pulled by a force of about 120 gf in the direction in which a paper is carried forward due to friction caused between the heat-resistant sheet 74 and fusing roller 52. However, the heat-resistant sheet 74 will not separate from the lower frame 73 because the bonding strength of the heat-resistant sheet 74 to the lower frame 73 is over 1000 gf even when the adhesive agent 74*a* is applied in the minimum width of $L_{2min}$. In addition, since the heat-resistant sheet 74 is reinforced by the glass fiber against the tensile force, the heat-resistant sheet 74 will not go slack due to heat or tensile force of the fusing roller 52. Moreover, in case the fluororesin is impregnated into the glass fiber substrate, the heat-resistant sheet 74 has better bonding strength compared with a conventional coating with a fluororesin, thereby rendering excellent wear resistance. In short, durability of the heat-resistant sheet 74 can be improved.

Since the heat-resistant sheet 74 is wider than the pressing member 51 in the direction in which a paper is carried forward and fixed to the lower frame 73, the heat-resistant sheet 74 can also serve as a paper guide to carry a paper forward in a stable manner. Further, since the heat-resistant sheet 74 is fixed to the lower frame 73, (1) the heat-resistant sheet 74 can adhere to the lower frame 73 in a broader area, thereby rendering sufficient bonding strength easily, and (2) no friction will be caused between the pressing member 51 and the fusing roller 52 when it rotates, and thus the pressure is applied to the pressing member 51 only in a vertical direction, thereby eliminating the problem caused by the conventional pressing pad method, namely, deformation of the pressing member 51 due to a shear force.

Also, the pressing member 51 can be downsized to such an extent that a sufficient nip width is secured (the nip width of the pressing member 51 is 4 mm herein). Thus, the device can be downsized and the manufacturing costs can be reduced. Further, the pressing member 51 can press the heat-resistant sheet 74 to the fusing roller 52 in a longitudinal direction thereof under an even pressure. Therefore, a toner image can be fused evenly. Moreover, compared with the conventional pressing sheet method, a pressure per unit area can be raised while the nip width can be narrowed (the nip width is 1 mm herein), and therefore, the paper 1 will hardly curl.

Next, the relation between the pressure applied by the pressing springs 58 and the toner fusing reliability, readiness in carrying a used parer, etc. were examined. Note that the applied pressure referred herein means the total pressure applied by the two pressing springs 58, and the fusing reliability means a survival rate of the toner after a rubbing test. Also, the readiness in carrying a used paper means whether paper jam occurred or not when a sample paper whose back side was 100% black solid was carried through. Smear of the image on the back side was examined whether an image was smeared or not after a sample paper whose back side is printed with a 0.2 mm wide ruled line in the longitudinal direction of the fusing roller 52 was carried through. The results of the evaluation are set forth in TABLE 2 below.

TABLE 2

| APPLIED PRESSURE (gf) | FUSING RELIABILITY (SURVIVAL RATE %) | READINESS IN CARRYING USED PAPER | SMEARED IMAGE |
|---|---|---|---|
| 800 | X(73.2) | ○ | ○ |
| 1000 | ○(89.7) | ○ | ○ |
| 1200 | ○(88.7) | ○ | ○ |
| 1400 | ○(95.6) | ○ | ○ |
| 1600 | ○(93.1) | X | X |

Fusing reliability
○: 80% or more
X: below 80%
Readiness in carrying used paper

TABLE 2-continued

| APPLIED PRESSURE (gf) | FUSING RELIABILITY (SURVIVAL RATE %) | READINESS IN CARRYING USED PAPER | SMEARED IMAGE |
|---|---|---|---|

○: no paper jam
X: there occurs paper jam
Smeared image
○: no image is smeared
X: an image is smeared These results reveal that raising the applied pressure can improve the fusing reliability, but in turn, decreases the readiness in carrying a used paper and increases smear of the image. This is because the nip width is widened as the applied pressure is increased, and therefore, the back side of the paper 1 is heated longer besides the paper 1 adheres to the heat-resistant sheet 74 more tightly. TABLE 2 indicates that a preferred applied pressure such that satisfies the conditions as to the fusing reliability, readiness in carrying a used paper, and the smear of image on the back side is in a range between 1000 and 1400 gf. Therefore, when the applied pressure is set in the above range, not only sufficient fusing reliability is ensured, but also the problem caused in case of double-side printing, namely, smeared image or paper jam, can be eliminated. In the present invention, each pressing spring 58 applies a pressure of 600 gf, making a total applied pressure of 1200 gf.

Next, the fusing reliability (i.e., the survival rate after the rubbing test) was compared in cases where the heat-resistant sheet 74 and pressing member 51 (silicon sponge rubber herein) were laminated to each other by a heat-resistant double-side tape and where the heat-resistant sheet 74 and pressing member 51 were not laminated to each other. The results of comparison are set forth in TABLE 3 below.

TABLE 3

| | FUSING RELIABILITY (SURVIVAL RATE %) |
|---|---|
| LAMINATED | 72.5 |
| NOT LAMINATED | 88.7 |

TABLE 3 reveals that the fusing reliability is improved when the heat-resistant sheet 74 and pressing member 51 are not laminated to each other. This is because, when the heat-resistant sheet 74 and pressing member 51 are laminated to each other by a heat-resistant double-side tape, resilience effects of the silicon sponge rubber is reduced due to the thickness and hardness of the tape, and binding caused by lamination, thereby narrowing the nip width compared with the case where the heat-resistant sheet 74 and pressing member 51 are not laminated to each other. Thus, if the heat-resistant sheet 74 and pressing member 51 are not laminated to each other, the fusing reliability can be improved without impairing the pressing effect of the pressing member 51.

Next, the permanent deformation of the pressing member 51 and the fusing reliability were evaluated by changing the kinds and hardness of the pressing member 51. Deformation caused when the pressing member 51 was subject to stand under high temperature and humidity (35° and 90%, respectively) was recorded as the permanent deformation. The results of the evaluation are set forth in TABLE 4 below.

TABLE 4

| SILICON SPONGE RUBBER | | | SILICON SOLID RUBBER | | |
|---|---|---|---|---|---|
| HARDNESS (ASKER C) | FUSING RELIABILITY | PERMANENT DEFORMATION | HARDNESS (JIS A) | FUSING RELIABILITY | PERMANENT DEFORMATION |
| 20° | ○ | X | 15° | X | ○ |
| 30° | ○ | ○ | 25° | X | ○ |
| 40° | ○ | ○ | 35° | X | ○ |

Fusing reliability
○:survival rate is 80% or more
X: survival rate is less than 80%
Permanent deformation
○: less than 5%
X: 5% or more When the pressing member 51 was silicon solid rubber, no problem occurred in terms of permanent deformation. However, since the silicon solid rubber is harder than silicon sponge rubber, the pressing member 51 could not secure a nip width evenly, thereby fusing a toner image unevenly in the longitudinal direction of the fusing roller 52. When the pressing member 51 was silicon sponge rubber, no permanent deformation occurred and the fusing reliability was satisfactory if the hardness thereof was 30° or more in ASKER C. Although using pressing member 51 having a hardness of 20° or less in ASKER C realized satisfactory fusing reliability, it was too soft and caused permanent deformation.

Thus, if the pressing member 51 is a resilient foam material with a hardness exceeding 20° in ASKER C, the pressing member 51 can eliminate permanent deformation while ensuring satisfactory fusing reliability. The pressing member 51 of the present embodiment is silicon sponge rubber with a hardness of 30° in ASKER C.

THIRD EMBODIMENT

Figure 15:
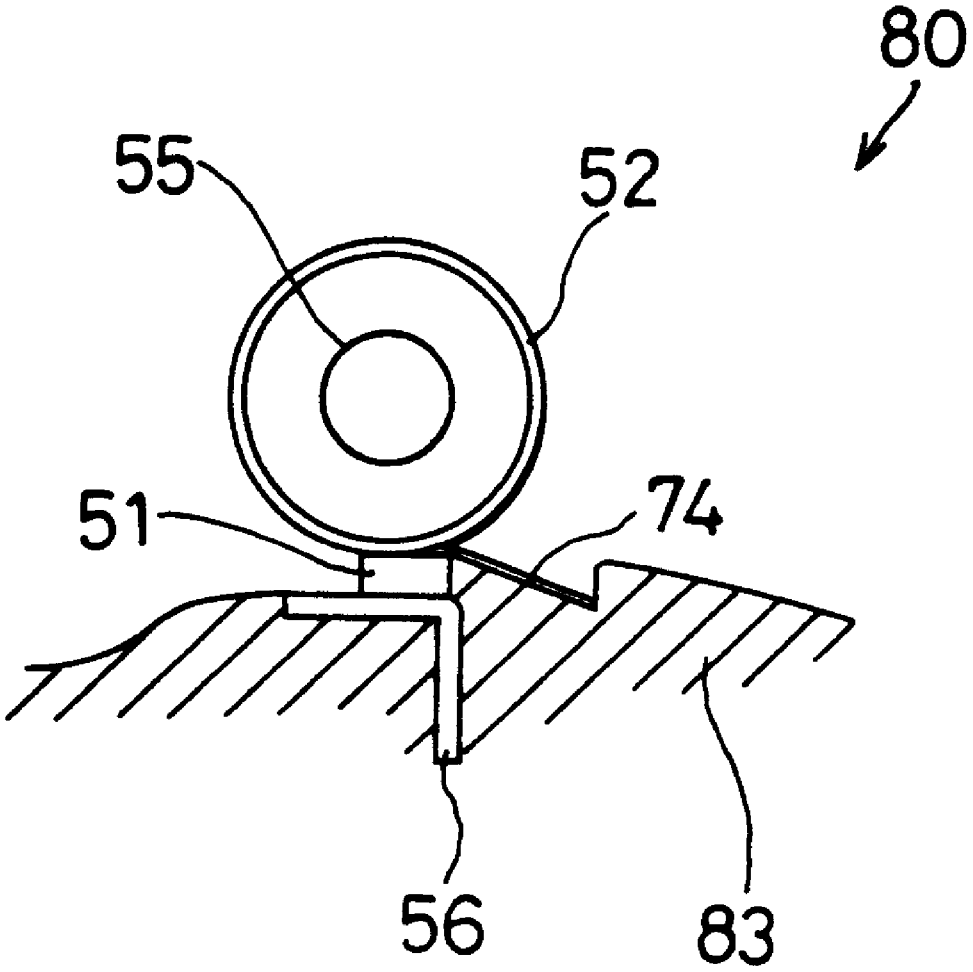
FIG. 15 is a cross sectional view depicting the structure of an example fusing device in accordance with the third embodiment of the present invention.
Figure 16:
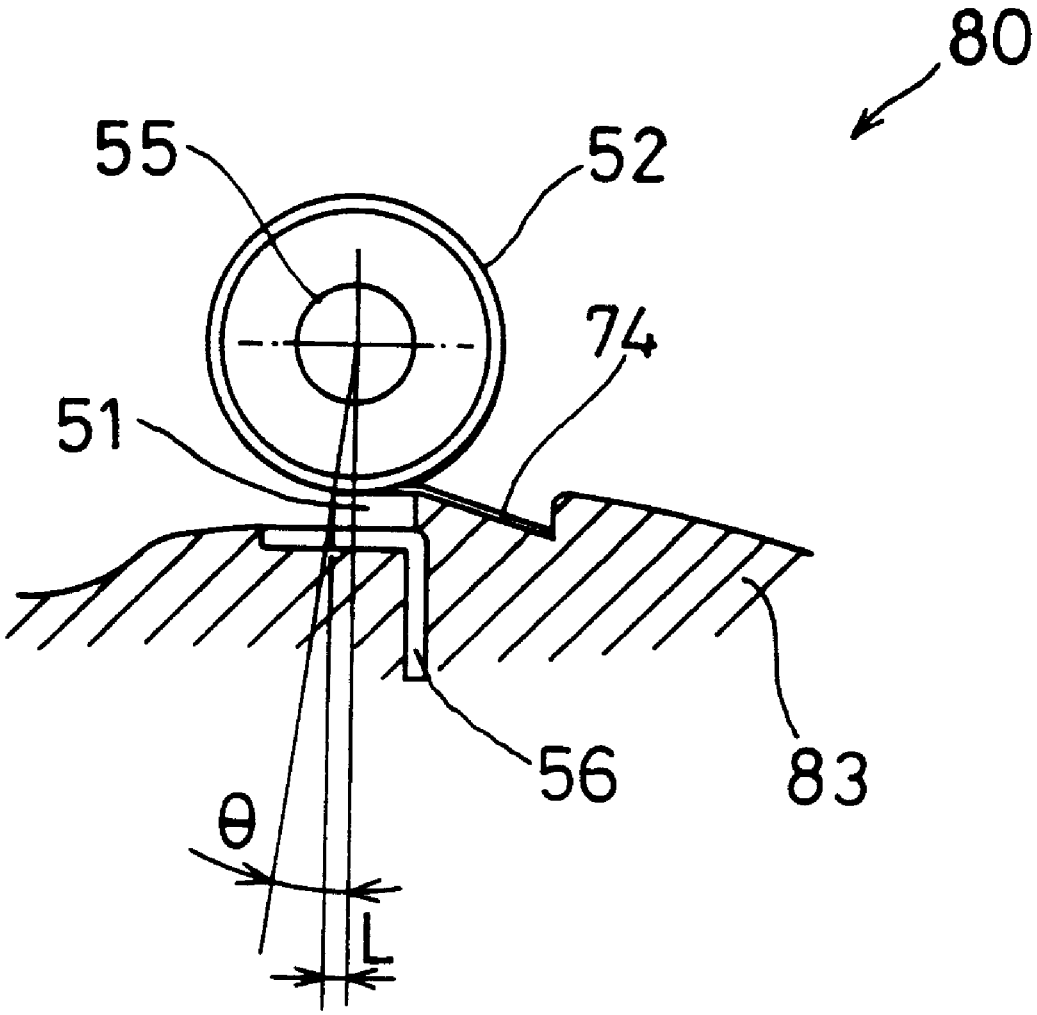
FIG. 16 is a view explaining a method of measuring an amount of curl of a paper caused by the above fusing device.
Figure 17:
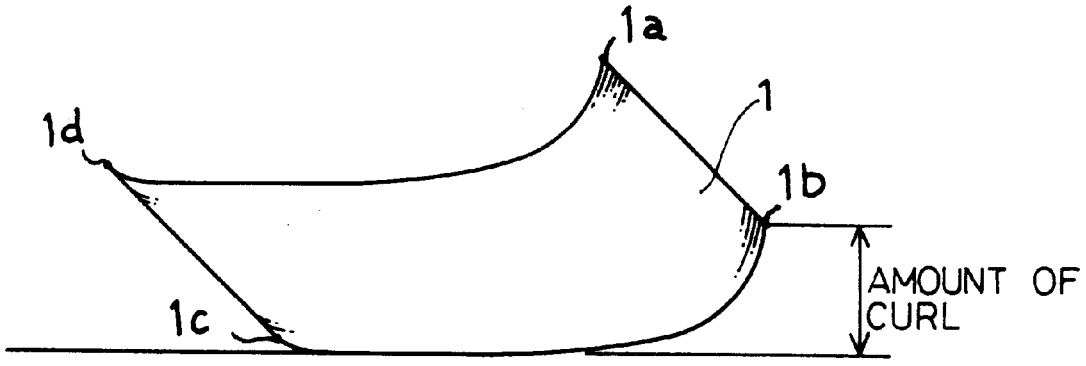
FIG. 17 is a view explaining the amount of curl of a paper.

Referring to FIGS. 15 through 17, the following description will discuss an example of the third embodiment in accordance with the present invention. Hereinafter, like components are labeled with like reference numerals with respect to the above embodiments, and the description of these components is not repeated for the explanation's convenience.

As shown in FIG. 15, a fusing device 80 of the present embodiment includes a lower frame 83, a pressing member 51, and a fusing roller 52, and the heat-resistant sheet 74 used in the second embodiment is also used in the present embodiment.

More specifically, the fusing roller 52 is composed of a thin aluminium cylinder (Φ14 mm, thickness t of 0.5 mm) whose outer circumference surface is entirely coated with a synthetic resin material having satisfactory mold lubrication, paper carrying ability, and heat resistance, for example, heat-resistant rubber having satisfactory paper carrying ability, such as fluoride rubber and silicon rubber whose main ingredient is a fluororesin having satisfactory mold lubrication represented by PTFE, PFA, or the like. The heater lamp 55 is installed in the center of axis of the fusing roller 52.

The pressing member 51 is silicon sponge rubber of 2 mm thick, and bonded to the lower frame 83 through the L-shaped metal plate 56. The pressing member 51 has a hardness of about 30° in ASKER C. The heat-resistant sheet 74, which is wider than the pressing member 51 in the direction in which a paper is carried forward, is placed atop of the pressing member 51. The heat-resistant sheet 74 is composed of a glass fiber substrate (100 μm thick) coated with or impregnating a synthetic resin material (100 μm thick) having good mold lubrication and heat resistance, such as fluororesins represented by PFA, PTFE, and the like. In short, the heat-resistant sheet 74 is 200 μm thick. The heat-resistant sheet 74 is bonded to the lower frame 83 by a heat-resistant resin in the upstream side in the direction in which a paper is carried forward.

The lower frame 83, compared with the lower frame 73 of the second embodiment, has a larger difference (2.5 mm herein) in height of the steps where the heat-resistant sheet 74 is attached. In other words, the steps are made in such a manner that the upstream side of the lower frame 83 is higher than the end point of the heat-resistant sheet 74 when the heat-resistant sheet 74 is fixed to the lower frame 83. The structure above the fusing roller 52 is identical with that in the first embodiment.

According to the above structure, the lower frame 83 has steps and the heat-resistant sheet 74, which is wider than the pressing member 51 in the direction in which a paper is carried forward, is placed on the step surface in the upstream side in the same direction. Thus, the heat-resistant sheet 74 can also serve as a pre-fused paper guide, which improves readiness in carrying a paper. Also, compared with the second embodiment, a paper can be carried forward in a more stable manner because the difference in height of the steps is increased in the present embodiment.

Next, an amount of curl of a paper was measured using the fusing device 80. The amount of curl was measured, as shown in FIG. 16, when there occurs a change in a distance L, the shortest distance from a vertical axis passing through the center of the fusing roller 52 to the end point of the heat-resistant sheet 74 or pressing member 51 in the downstream side in the direction in which a paper is carried forward. As shown in FIG. 17, the amount of curl is calculated by:

(1) placing the paper 1 on a plane surface after the paper 1 is carried through;

(2) averaging a total of heights from the plane surface to four corners, 1*a*, 1*b*, 1*c*, and 1*d*, of the paper 1; and (3) averaging a total of the averaged heights of ten papers.

A preferred amount of curl is 8 mm or less. The results of measurement are set forth in TABLE 5 below.

TABLE 5

| DISTANCE L (mm) | AMOUNT OF CURL (mm) | EVALUATION |
|---|---|---|
| 0.5 | 4.1 | ○ |
| 1 | 4.8 | ○ |
| 2 | 7.2 | ○ |
| 2.5 OR MORE | 15 OR MORE | X |

○: less than 8 mm
X: 8 mm or more

It is understood that the shorter the distance L, the less the amount of curl. However, when the distance L is nil, no nip width is secured between the fusing roller 52 and heat-resistant sheet 74. When each pressing spring 58 applies 600 gf to the heat-resistant sheet 74 (the total of applied pressure is 1200 gf), there is formed a nip width of about 1 mm. Thus, the minimum value of the distance L, 0.5 mm, is found by dividing the nip width by two. When the distance L is longer than 2 mm (L>2 mm), the amount of curl does not satisfy the reference value, that is, 8 mm or less. Therefore, only when the distance L satisfies a condition, namely, $0.5 \leqq L \leqq 2$, the fusing device 80 can ensure satisfactory fusing reliability while reducing the amount of curl.

As shown in FIG. 16, let θ represent the angle which a line linking the bottom end of the heat-resistant sheet 74 or pressing member 51 and the center of the fusing roller 52 makes with a normal line of the heat-resistant sheet 74 or pressing member 51, then, $L \leqq 2$ in the above condition can be re-written as $\theta < 20°$.

Further, another experiment was performed in the same manner except that the diameter of the fusing roller 52 was increased to Φ30 from Φ14, the results of which are set forth in TABLE 6 below.

TABLE 6

| DISTANCE L (mm) | AMOUNT OF CURL (mm) | EVALUATION |
|---|---|---|
| 1 | 3.6 | ○ |
| 2 | 5.6 | ○ |
| 4 | 5.3 | ○ |
| 5 | 9.5 | X |
| 8 | 9.8 | X |

○: less than 8 mm
X: 8 mm or more

It is understood that when $L \leqq 4$, the amount of curl satisfies the reference value, that is, 8 mm or less. Note that $L \leqq 4$ can be re-written as $\theta < 20°$. Thus, when a condition, that is, $0 < \theta < 20°$ is satisfied, not only the amount of curl is reduced, but also image characteristics can be realized satisfactorily. The heat-resistant sheet 74 and pressing member 51 are aligned at their bottom ends in the downstream side in the direction in which a paper is carried forward in this embodiment; however, the same results were obtained when the heat-resistant sheet 74 was longer than the pressing member 51 in the same direction.

FOURTH EMBODIMENT

Figure 18:
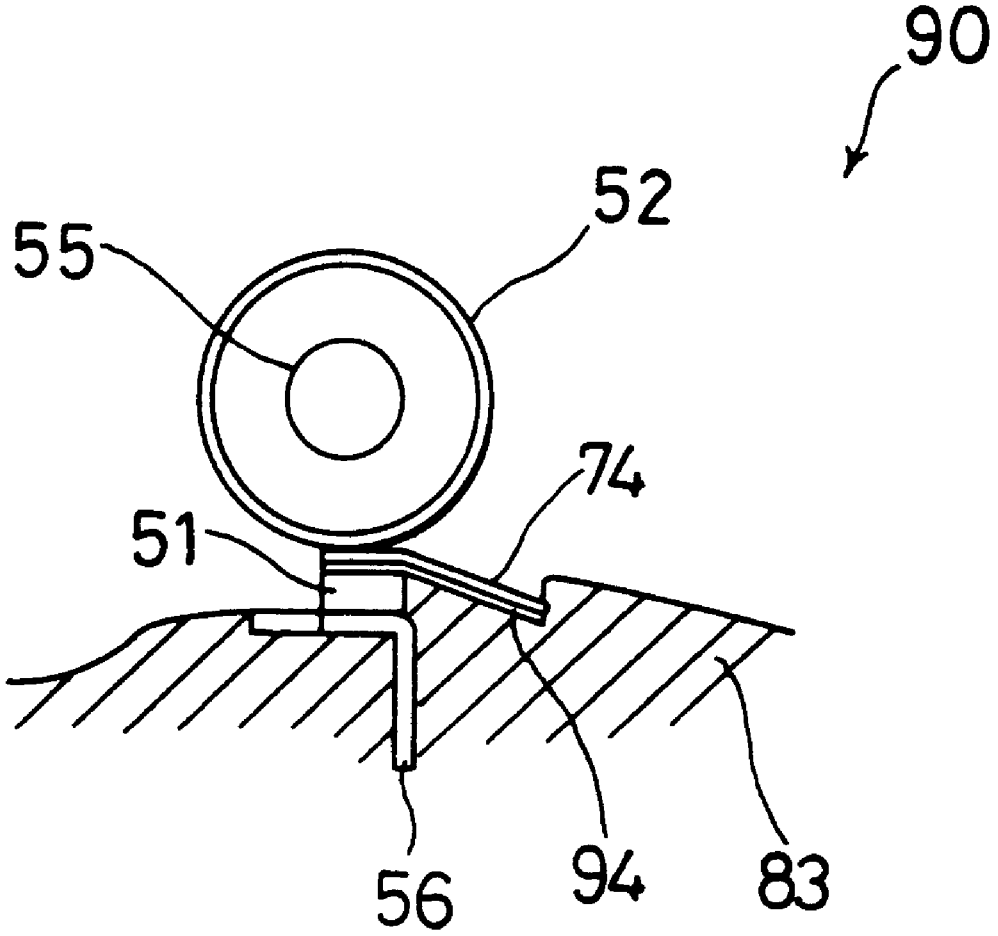
FIG. 18 is a cross sectional view depicting the structure of an example fusing device in accordance with the fourth embodiment of the present invention.
Figure 19B:
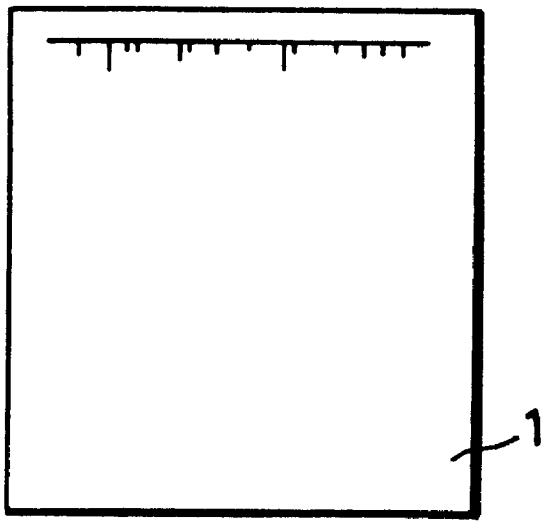
FIG. 19(*a*) is a view explaining a case where an image is not smeared when the above fusing device is used.
Figure 19A:
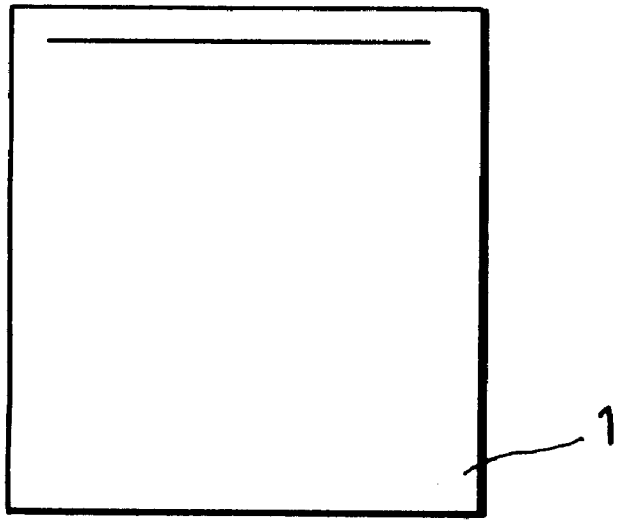
Figure 20:
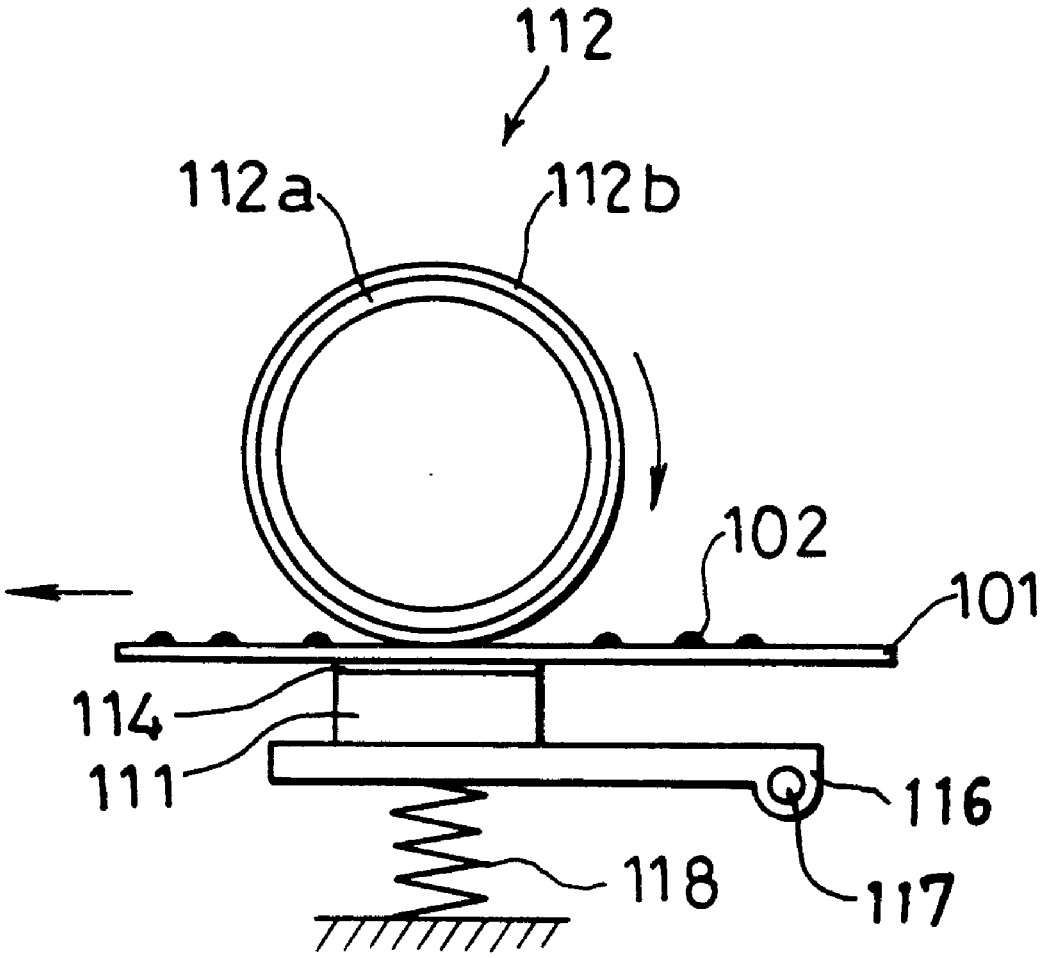
FIG. 20 is a cross sectional view depicting the structure of an example fusing device of a conventional pressing pad method.
Figure 21:
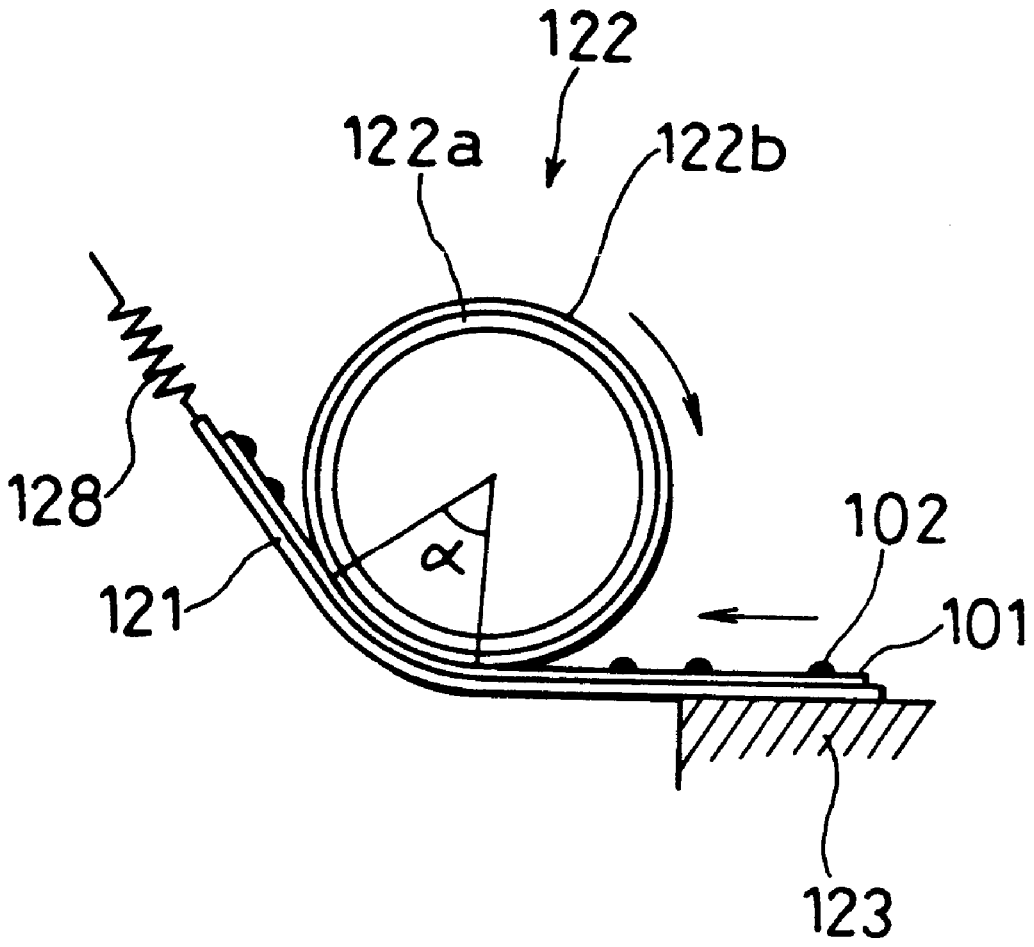
FIG. 21 is a cross sectional view depicting the structure of an example fusing device of a conventional pressing sheet method.
Figure 22:
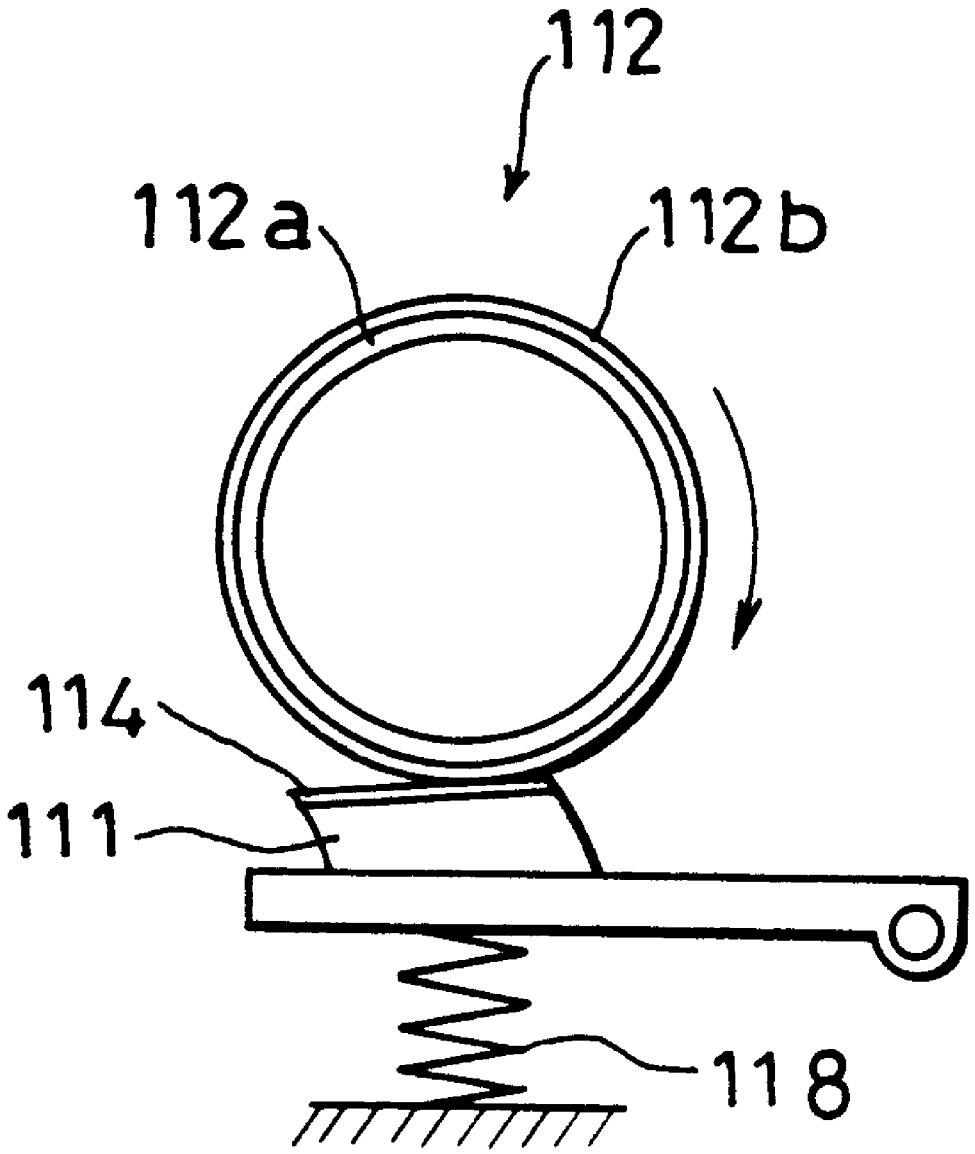

Referring to FIGS. 18 and 19, the following description will discuss an example of the fourth embodiment of the present invention. Hereinafter, like components are labeled with like reference numerals with respect to the above embodiments, and the description of these components is not repeated for the explanation's convenience.

As shown in FIG. 18, a fusing device 90 of the present embodiment includes the lower frame 83, the pressing member 51 and fusing roller 52 like the counterpart in the third embodiment, and metal foil 94 and the heat-resistant sheet 74 are formed atop of the pressing member 51 in this order.

The pressing member 51 is silicon sponge rubber of 2 mm thick having a hardness of about 30° in ASKER C. The pressing member 51 is bonded to the lower frame 83 through the L-shaped metal plate 56. The heat-resistant sheet 74 is composed of a glass fiber substrate (100 μm thick) coated with or impregnating a synthetic resin material (100 μm thick) having good mold lubrication and heat resistance, such as fluororesins represented by PFA, PTFE, and the like. In short, the heat-resistant sheet 74 is 200 μm thick. The metal foil 94 beneath the heat-resistant sheet 74 is hard aluminium foil (40 μm thick), and the heat-resistant sheet 74 as well as the metal foil 94 is laminated to the lower frame 83 in the upstream side in the direction in which a paper is carried forward. The heat-resistant sheet 74 is bonded to the metal foil 94 by a heat-resistant resin of 30 μm thick and the metal foil 94 is bonded to the lower frame 83 by a heat-resistant resin. The structure of the fusing device 90 above the fusing roller 52 is identical with the counterpart of the first embodiment.

Tests on the fusing reliability and smear of the image on the back side were performed using the above-structured fusing device 90. Three kinds of materials—hard aluminium foil, copper, and stainless—each having a thickness of 40 μm were used as the metal foil 94. The paper carrying rate was 25 mm/sec. and the temperature of the fusing roller 52 was 140° C. The smear of the image on the back side was examined whether an image was smeared or not when a sample paper whose back side was printed with a 0.5 mm wide ruled line 5 mm from the top end of the paper 1 in the longitudinal direction of the fusing roller 52 was carried through. FIG. 19 shows cases when an image is not smeared and when an image is smeared. The results of evaluations are set forth in TABLE 7 below.

TABLE 7

| METAL FOIL MATERIAL (40 μm) | FUSING RELIABILITY (SURVIVAL RATE %) | SHEAR OF IMAGE | TEMPERATURE OF HEAT-RESISTANT SHEET (° C.) | EVALU-ATION |
|---|---|---|---|---|
| HARD ALU-MINIUM FOIL | ◎(90.3) | ○ | 115 | AA |
| COPPER FOIL | ○(89.9) | ○ | 113 | A |
| STAINLESS FOIL | ○(87.5) | Δ | 120 | B |

Fusing reliability
◎: survival rate is 90% or more
○: survival rate is 80% or more
Smear of image
○: no image is smeared
Δ: an image was smeared occasionally
Judgement
AA: excellent
A: fair
B: poor occasionally It is understood that, unlike stainless foil having poor thermal conductivity, aluminium foil and copper foil having good thermal conductivity cause substantially no smear of the image. Also, the temperatures of the heat-resistant sheet 74 (PTFE sheet) immediately after a paper was carried through were 115° C., 113° C., and 120° C. when the metal foil 94 was aluminium foil, copper foil, and stainless foil, respectively. The reason of such temperature difference is that heat accumulated in the PTFE sheet was transferred to the metal foil 94 underneath. Thus, inserting the metal foil 94 having good thermal conductivity, such as aluminium and copper, between the heat-resistant sheet 74 and pressing member 51 makes it possible to ensure satisfactory fusing reliability while eliminating the problems that occur in case of the double-side printing, such as smeared image and paper jam. Hard aluminium foil is used in the present embodiment in terms of performance and manufacturing costs of the device.

Further, the changes of the fusing reliability, etc. depending on the thickness of the metal foil 94, namely, aluminium foil, were examined, the results of which are set forth in TABLE 8 below.

TABLE 8

| THICK-NESS OF ALU-MINIUM FOIL (μm) | FUSING RELIABILITY (SURVIVAL RATE %) | SMEAR OF IMAGE | TEMPERATURE OF HEAT-RESISTANT SHEET (° C.) | EVALU-ATION |
|---|---|---|---|---|
| NO FOIL | ◎(91.0) | X | 123 | B |
| 40 | ◎(90.3) | ○ | 115 | AA |
| 70 | ○(85.8) | ○ | 113 | A |
| 100 | Δ(78.2) | ○ | 109 | B |
| 150 | X(69.5) | ◎ | 104 | C |

Fusing reliability
◎: survival rate is 90% or more
○: survival rate is 80% or more
Δ: survival rate is 70% or more
X: survival rate is less than 70%
Smear of image
○: no image is smeared
Δ: substantially no image is smeared
X: an image is smeared
Evaluation
AA: excellent
A: fair
B: poor occasionally
C: poor When no aluminium foil was used, the image was considerably smeared and the temperature of the PTFE sheet was as high as 123° C. When the aluminium foil was 150 μm thick, no image was smeared but the fusing reliability was reduced to 69.5%. Thus, it is understood that a preferable thickness of the metal foil 94 of the heat-resistant sheet 74 is 100 μm or less, and a more preferable thickness is in a range between 40 and 70 μm.

The heat-resistant sheet 74 used in the present embodiment was a synthetic resin material having good mold lubrication, smoothness, and heat resistance, namely, a sheet made mainly out of PTFE with a glass fiber substrate of 100 μm thick. However, since PTFE has a thermal conductivity as low as 0.2 kcal/m·h·° C., the metal foil 94 was inserted beneath the heat-resistant sheet 74 to eliminate smear of the image by lowering the temperature of the heat-resistant sheet 74. Here, the metal foil 94 was not inserted in the heat-resistant sheet 74, and instead, some percents of a material having good thermal conductivity (improved by a factor of about 700 compared with PTFE), such as carbon, molybdenum, graphite, and boron nitride, was mixed with PTFE of the heat-resistant sheet 74, and tests were conducted in the same manner as above, the results of which are set forth in TABLE 9 below.

TABLE 9

| MATERIAL MIXED WITH HEAT-RESISTANT SHEET | FUSING RELIA-BILITY | SMEAR OF IMAGE | TEMPERATURE OF HEAT-RESISTANT SHEET (° C.) | EVALU-ATION |
|---|---|---|---|---|
| NONE | ○ | X | 123 | B |
| C2% | ○ | ○ | 116 | A |
| C5% | ○ | ○ | 114 | A |
| BN2% | ○ | ○ | 117 | A |
| BN5% | ○ | ○ | 116 | A |
| Mo2% | ○ | ○ | 116 | A |
| Gf2% | ○ | ○ | 113 | A |

Fusing reliability . . .
○: 80% or more
Smear of image . . .
○: no image is smeared TABLE 9-continued

| MATERIAL MIXED WITH HEAT-RESISTANT SHEET | FUSING RELIA-BILITY | SMEAR OF IMAGE | TEMPERATURE OF HEAT-RESISTANT SHEET (° C.) | EVALU-ATION |
|---|---|---|---|---|

X: an image is smeared occasionally
Evaluation . . .
A: fair
B: poor occasionally It is understood that, when a material having good thermal conductivity was mixed with the heat-resistant sheet 74, the temperature thereof was lowered, and therefore, not only the smear of an image was eliminated, but also the printing quality was satisfactory. Thus, mixing a material having good thermal conductivity makes it possible to ensure satisfactory fusing reliability while eliminating problems caused in case of double-side printing, such as a smeared image or paper jam.

The invention being thus described, it will be obvious that the same may be varied in many ways. Such variations are not to be regarded as a departure from the spirit and scope of the invention, and all such modification as would be obvious to one skilled in the art are intended to be included within the scope of the following claims.

What is claimed is:

1. A fusing device for fixedly adhering a pre-fused toner image onto a recording material comprising:

a fusing roller;

a pressing member made of a resilient material, said pressing member being pressed against an outer circumference surface of said fusing roller under an even pressure;

a sheet composed of a substrate made of a glass fiber, said sheet being placed on a surface of said pressing member brought into contact with said fusing roller;

a pressing member fixing stand to which said pressing member is fixed, said pressing member fixing stand having an upper surface and a lower surface, said upper surface, made in an upstream side in the direction in which a recording material is carried forward, being higher than said lower surface by a total of thicknesses of said pressing member and said sheet;

said upper surface being leveled in such a manner that, when said sheet is fixed to a leveled portion, an upstream side of the leveled portion is higher than an end portion of said sheet in the upstream side;

a surface of said pressing member, opposing a surface of said pressing member where said sheet is layered, being fixed to said lower surface in a vicinity of a boundary of said upper surface and said lower surface;

a recording material being carried through a section between said fusing roller and said sheet as said fusing roller rotates.

2. The fusing device as defined in claim 1, wherein the glass fiber substrate of said sheet is coated with a fluororesin.

3. The fusing device as defined in claim 2, wherein said fluororesin is one of a polytetrafluoroethylene=perfluoroalkylvinylether copolymer resin and a polytetrafluororethylene resin.

4. The fusing device as defined in claim 1, wherein the glass fiber substrate of said sheet impregnates a fluororesin.

5. The fusing device as defined in claim 4, wherein said fluororesin is one of a polytetrafluoroethylene=perfluoroalkylvinylether copolymer resin and a polytetrafluororethylene resin.

6. The fusing device as defined in claim 1, wherein a recording material has a larger friction coefficient with said fusing roller than said heat-resistant sheet.

7. The fusing device as defined in claim 6, wherein said heat-resistant sheet satisfies a relation expressed as:

$$F_2,\ F_2'>F_3>F_1,$$

where $F_1$ is a surface tension between said fusing roller and toner, $F_2$ is a surface tension between a surface of a recording material in a fusing roller side and the toner, $F_2'$ is a surface tension between a surface of the recording material in a heat-resistant sheet side and toner, and $F_3$ is a surface tension between said heat-resistant sheet and the toner.

8. The fusing device as defined in claim 7, wherein a paper carrying force of said fusing roller is not more than 300 gf, said paper carrying force being defined as a force, which suspends a paper carrying action while said fusing roller is rotating, measured at a point where the paper carrying action resumes as the force is gradually reduced.

9. The fusing device as defined in claim 1, wherein said sheet is as wide as said pressing member in a direction in which a recording material is carried forward.

10. The fusing device as defined in claim 9 further comprising a pressing member fixing stand having an upper surface and a lower surface, said upper surface, made in an upstream side in the direction in which a recording material is carried forward, being higher than said lower surface by a total of thicknesses of said pressing member and sheet, a surface of said pressing member, opposing a surface of said pressing member on which said heat-resistant sheet is layered, being fixed to said lower surface in a vicinity of a boundary of said upper surface and lower surface.

11. The fusing device as defined in claim 1 wherein:

said sheet is wider than said pressing member in a direction in which a recording material is carried; and a wider portion of said sheet is fixed to said pressing member fixing stand in an upstream side with respect to said pressing member in said direction.

12. The fusing device as defined in claim 11, wherein said sheet is not bonded to said pressing member.

13. The fusing device as defined in claim 11, wherein said pressing member fixing stand has an upper surface and a lower surface, said upper surface, made in an upstream side in the direction in which a recording material is carried forward, being higher than said lower surface by a total of thicknesses of said pressing member and sheet, said upper surface being slightly levelled, whereby said sheet is fixed to said leveled portion smoothly, a surface of said pressing member, opposing a surface of said pressing member where said sheet is layered, being fixed to said lower surface in a vicinity of a boundary of said upper surface and lower surface.

14. The fusing device as defined in claim 1, wherein said fusing roller applies a pressure to said pressing member in a range between 1000 and 1400 gf.

15. The fusing device as defined in claim 1, wherein said pressing member is made of a resilient foam material having a hardness exceeding 20° in ASKER C.

16. The fusing device as defined in claim 15, wherein said resilient material is silicon sponge rubber.

17. The fusing device as defined in claim 1, wherein a position of said pressing member with respect to said fusing roller is set to satisfy a relation expressed as:

$0° < \theta < 20°$ where θ is an angle which a normal line extending from a center of said fusing roller toward said pressing member makes with a line linking the center of said fusing roller and an end point of said pressing member in a downstream side in a direction in which a recording material is carried forward.

18. The fusing device as defined in claim 17, wherein a shortest distance from said normal line to the end point of said pressing member in the downstream side in the direction in which a recording material is carried forward is not less than 0.5 mm.

19. The fusing device as defined in claim 1 further comprising metal foil inserted between said sheet and pressing member.

20. The fusing device as defined in claim 19, wherein said metal foil is one of aluminium foil and copper foil.

21. The fusing device as defined in claim 20, wherein said aluminium foil is not more than 100 μm thick.

22. The fusing device as defined in claim 20, wherein a thickness of said aluminium foil is in a range between 40 and 70 μm.

23. The fusing device as defined in claim 1, wherein said sheet includes a slight amount of a material having better thermal conductivity than the glass fiber.

24. The fusing device as defined in claim 23, wherein said material having better thermal conductivity is one of carbon, molybdenum, graphite, and boron nitride.

25. A fusing device for fixedly adhering a pre-fused toner image onto a recording material comprising:

a fusing roller;

a pressing member made of a resilient material, said pressing member being pressed against an outer circumference surface of said fusing roller under an even pressure;

a sheet composed of a substrate made of a glass fiber, said sheet being placed on a surface of said pressing member brought into contact with said fusing roller;

metal foil inserted between said sheet and said pressing member;

a recording material being carried through a section between said fusing roller and said sheet as said fusing roller rotates.

26. The fusing device as defined in claim 25 further comprising:

a pressing member fixing frame having an upper surface and a lower surface formed by raising an upstream side surface thereof with respect to said pressing member in a direction in which said recording material is carried by a total of thicknesses of said pressing member, metal foil, and sheet, a difference in height of steps having a thickness larger than a total of thicknesses of said metal foil and sheet being provided to said upper surface; wherein a width of each of said sheet and said metal foil in a direction in which said recording material is carried is formed longer than a width of said pressing member, said sheet being bonded to said metal foil, a surface opposite to a sheet bonding surface of said metal foil is fixed to said difference in height of steps at a portion produced longer, and a surface opposite to a metal foil forming surface of said pressing member is fixed onto said lower surface approximating to a boundary of said upper surface and lower surface.

27. The fusing device as defined in claim 26, wherein said metal foil is not bonded to said pressing member.

* * * * *